US008674891B2

(12) United States Patent
Lopez et al.

(10) Patent No.: US 8,674,891 B2
(45) Date of Patent: Mar. 18, 2014

(54) TUNABLE METAMATERIAL ANTENNA STRUCTURES

(75) Inventors: Norberto Lopez, San Diego, CA (US); Ajay Gummalla, San Diego, CA (US)

(73) Assignee: Tyco Electronics Services GmbH (CH)

( * ) Notice: Subject to any disclaimer, the term of this patent is extended or adjusted under 35 U.S.C. 154(b) by 933 days.

(21) Appl. No.: 12/619,109

(22) Filed: Nov. 16, 2009

(65) Prior Publication Data

US 2010/0123635 A1 May 20, 2010

Related U.S. Application Data

(60) Provisional application No. 61/116,232, filed on Nov. 19, 2008.

(51) Int. Cl.

| | |
|---|---|
| ***H01Q 19/06*** | (2006.01) |
| ***H01Q 15/02*** | (2006.01) |
| ***H01Q 1/38*** | (2006.01) |

(52) U.S. Cl.
USPC ..... 343/753; 343/909; 343/700 MS

(58) Field of Classification Search
USPC ..... 343/722, 753, 909, 911
See application file for complete search history.

(56) References Cited

U.S. PATENT DOCUMENTS

| | | | | |
|---|---|---|---|---|
| 6,005,519 | A | 12/1999 | Burns | |
| 8,299,967 | B2 | 10/2012 | Xu et al. | |
| 2008/0048917 | A1 * | 2/2008 | Achour et al. | 343/700 MS |
| 2008/0258981 | A1 | 10/2008 | Achour et al. | |
| 2008/0258993 | A1 | 10/2008 | Gummalla et al. | |

FOREIGN PATENT DOCUMENTS

| | | | |
|---|---|---|---|
| CN | 102308436 | A | 1/2012 |
| EP | 1014487 | | 6/2000 |
| KR | 1020110099700 | A | 9/2011 |

OTHER PUBLICATIONS

Caloz and Itoh, "Electromagnetic Metamaterials: Transmission Line Theory and Microwave Applications," John Wiley & Sons (2006).
Itoh, T., "Invited paper: Prospects for Metamaterials," Electronics Letters, vol. 40,(16):972-973, Aug. 2004.
U.S. Appl. No. 12/465,571, filed May 13, 2009 and entitled "Non-Planar Metamaterial Antenna Structures".
U.S. Appl. No. 11/741,674, filed Apr. 27, 2007 and entitled "Antennas, Devices and Systems Based on Metamaterial Structures".
U.S. Appl. No. 11/844,982, filed Aug. 24, 2007 and entitled "Antennas Based on Metamaterial Structures".
U.S. Appl. No. 12/270,410, filed Nov. 13, 2008 and entitled "Metamaterial Structures with Multilayer Metallization and Via".
U.S. Appl. No. 12/408,642, filed Apr. 2, 2009 and entitled "Single-Feed Multi-Cell Metamaterial Antenna Devices".

(Continued)

*Primary Examiner* — Robert Karacsony

(57) ABSTRACT

Apparatus and techniques that provide tuning elements in antenna devices to tune frequencies of the antenna devices, including composite right and left handed (CRLH) metamaterial (MTM) antenna devices. Examples of the tuning elements for CRLH MTM antenna devices include feed line tuning elements, cell patch tuning elements, meandered stub tuning elements, via line tuning elements, and via pad tuning elements tuning elements that formed near corresponding antenna elements such as the feed line, cell patch, meander stub, via line and via pad, respectively.

23 Claims, 34 Drawing Sheets

(56) References Cited

OTHER PUBLICATIONS

Lim, S.; et al. "Metamaterial-Based Electronically Controlled Transmission-Line Structure as a Novel Leaky-Wave Antenna With Tunable Radiation Angle and Beamwidth." IEEE Transactions on Microwave Theory and Techniques, vol. 52(12). Dec. 2004. pp. 2678-2690.
International Search Report and Written Opinion dated Jun. 18, 2010 for International Patent Application No. PCT/US2009/064862 filed Nov. 17, 2009 (9 pages).
Chinese Application Serial No. 200980154910.2, Amendment Filed Oct. 31, 2011, 6 pgs (with translation).
"Chinese Application Serial No. 200980154910.2, Office Action mailed May 2, 2013", (w/ English Summary), 8 pgs.
"European Application Serial No. 09828126.4, Response filed Oct. 3, 2013 to Extended European Search Report mailed Mar. 20, 2013", 16 pgs.
"European Application Serial No. 09828126.4, Extended European Search Report mailed Mar. 20, 2013", 6 pgs.

* cited by examiner

533

535

TUNABLE METAMATERIAL ANTENNA STRUCTURES

PRIORITY CLAIMS AND RELATED APPLICATIONS

This patent document claims the benefits of U.S. Provisional Patent Application Ser. No. 61/116,232 entitled "TUNABLE METAMATERIAL ANTENNA STRUCTURES" and filed on Nov. 19, 2008.

The disclosure of the above application is incorporated by reference as part of the disclosure of this document.

BACKGROUND

This document relates to Composite Right/Left Handed (CRLH) Metamaterial (MTM) antenna apparatus.

The propagation of electromagnetic waves in most materials obeys the right-hand rule for the (E, H, β) vector fields, which denotes the electrical field E, the magnetic field H, and the wave vector β (or propagation constant). The phase velocity direction is the same as the direction of the signal energy propagation (group velocity) and the refractive index is a positive number. Such materials are Right/Handed (RH) materials. Most natural materials are RH materials; artificial materials can also be RH materials.

A metamaterial (MTM) is an artificial structure. When designed with a structural average unit cell size of ρ much smaller than the wavelength of the electromagnetic energy guided by the metamaterial, the metamaterial behaves like a homogeneous medium to the guided electromagnetic energy. Unlike RH materials, a metamaterial may exhibit a negative refractive index, wherein the phase velocity direction is opposite to the direction of the signal energy propagation where the relative directions of the (E, H, β) vector fields follow a left-hand rule. Metamaterials that support only a negative index of refraction with permittivity ∈ and permeability μ being simultaneously negative are pure Left Handed (LH) metamaterials.

Many metamaterials are mixtures of LH metamaterials and RH materials and thus are CRLH metamaterials. A CRLH MTM can behave like an LH metamaterial at low frequencies and an RH material at high frequencies. Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

CRLH MTMs can be structured and engineered to exhibit electromagnetic properties that are tailored for specific applications and can be used in applications where it may be difficult, impractical or infeasible to use other materials. In addition, CRLH MTMs may be used to develop new applications and to construct new devices that may not be possible with RH materials.

SUMMARY

This document discloses, among others, examples of apparatus and techniques that provide tuning elements in antenna devices to tune frequencies of the antenna devices, including CRLH MTM antenna devices.

DETAILED DESCRIPTION

Figure 1A:
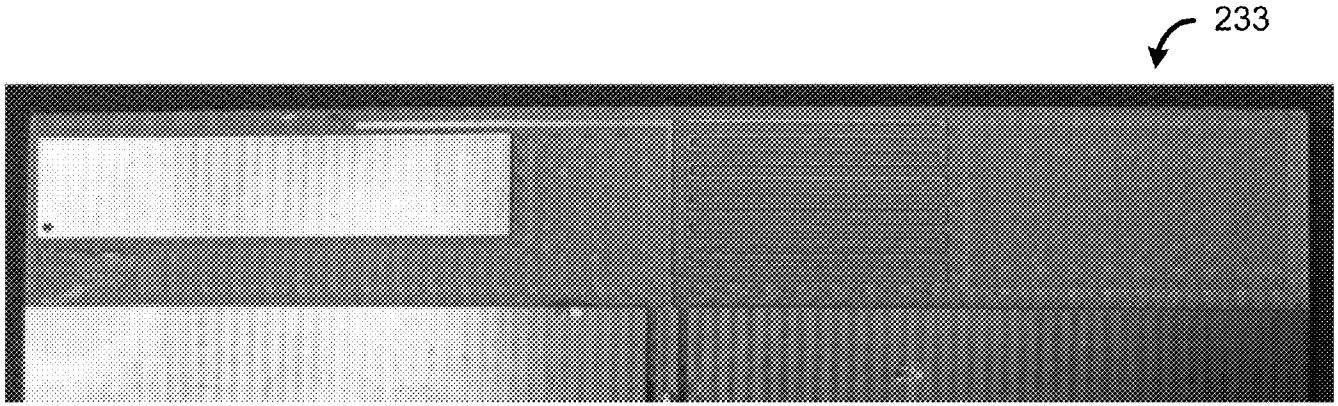
FIG. 1A illustrates a photograph of a top view of a top layer of a CRLH MTM antenna (Antenna 1) according to an example embodiment.

The following presents examples of techniques and CRLH MTM antenna devices that provide tuning elements to tune the frequencies of the antenna devices. Examples of different types of the tuning elements include feed line tuning elements, cell patch tuning elements, meandered stub tuning elements, via line tuning elements, and via pad tuning elements that are formed near corresponding antenna elements such as the feed line, cell patch, meander stub, via line and via pad, respectively. In some implementations, a CRLH MTM antenna device can include tuning elements of one type of tuning element or tuning elements of two or more different types of tuning elements.

In one aspect, a method is provided for tuning a resonant frequency of a CRLH MTM antenna device. This method includes providing a CRLH MTM antenna on a substrate, the CRLH MTM antenna comprising antenna elements that are structured and electromagnetically coupled to one another to form a CRLH MTM structure, and providing a plurality of conductive tuning elements that are separated from one another and from the CRLH MTM antenna, and that are formed at selected locations close to the CRLH MTM antenna. One or more conductive tuning elements located next to respective antenna elements are selected to connect the selected one or more conductive tuning elements to at least one of the respective antenna elements to make the selected one or more conductive tuning elements as part of the CRLH MTM antenna to tune a resonant frequency of the CRLH MTM antenna to be different from an initial value of the resonant frequency when the selected one or more conductive tuning elements are not connected.

In another aspect, a CRLH MTM antenna device is provided to include a CRLH MTM antenna on a substrate which includes antenna elements that are structured and electromagnetically coupled to one another to form a CRLH MTM structure. Electrically conductive tuning elements are provided on the substrate and are separated from one another and from the CRLH MTM antenna. The tuning elements are formed at selected locations close to the CRLH MTM antenna and are configured to allow tuning of a resonant frequency of the CRLH MTM antenna, when one or more of the electrically conductive tuning elements located next to respective antenna elements are connected to, or disconnected from, at least one of the respective antenna elements.

In another aspect, a metamaterial antenna device is provided to include a substrate, electrically conductive parts formed on the substrate, and tuning elements formed on the substrate. The electrically conductive parts are configured to form a CRLH MTM antenna structure that generates a first plurality of frequency resonances when none of the tuning elements is connected to any of the electrically conductive parts. One or more of the tuning elements, when electrically connected to the conductive parts, reconfigure the CRLH MTM antenna structure to generate a second plurality of frequency resonances different from the first plurality of frequency resonances.

In another aspect, a method is provided for tuning a metamaterial antenna device. This method includes providing a substrate for the metamaterial antenna device, forming a plurality of conductive parts on the substrate to form a CRLH MTM antenna structure that generates a first plurality of frequency resonances, forming a plurality of tuning elements on the substrate; and connecting one or more of the tuning elements to the conductive parts to reconfigure the CRLH MTM antenna structure in a way that generates a second plurality of frequency resonances.

In yet another aspect, a method is provided for tuning a resonant frequency of a CRLH MTM antenna device by changing one or more connections of permanently-formed components of the device. This method includes providing permanently-formed antenna components on a substrate that include permanently-formed conductive antenna elements on a substrate which are structured and electromagnetically coupled to one another to form a CRLH MTM structure, and permanently-formed electrically conductive tuning elements that are positioned at different locations from one another and from the permanently-formed antenna elements and are adjacent to respective permanently-formed conductive antenna elements. In this method, one or more permanently-formed electrically conductive tuning elements located next to respective permanently-formed antenna elements are selected to connect to at least one of the respective permanently-formed antenna elements to make the selected one or more permanently-formed electrically conductive tuning elements as part of the CRLH MTM antenna to tune a resonant frequency of the CRLH MTM antenna to be different from a value of the resonant frequency when the selected one or more permanently-formed electrically conductive tuning elements are not connected.

These and other aspects and associated techniques, devices and applications are described in greater detail in the drawings, and the description and the claims below.

CRLH MTMs can be structured and engineered to exhibit electromagnetic properties that are tailored for specific applications and can be used in applications where it may be difficult, impractical or infeasible to use other materials. In addition, CRLH MTMs may be used to develop new applications and to construct new devices that may not be possible with RH materials.

Various elements of a CRLH MTM antenna device can be constructed by using a substrate with a single metal layer or with multiple metallization layers. An antenna structure can be configured to include one or more CRLH unit cells that are fed by a feed line. The CRLH unit cell includes a cell patch that is connected to a ground plane through a via line. Additionally, for multiple metallization layers, a via can be included to connect the cell patch and the via line. The feed line guides a signal to or from the cell patch and can be, for example, connected to a coplanar waveguide (CPW) feed which serves as an impedance matching device and delivers power from a signal source to the distal end of the feed line. A narrow gap is provided between the distal end of the feed line and the cell patch to electromagnetically couple these elements. For example, in one embodiment, the width of the gap is 4-8 mils. The resonant frequencies, the matching of multiple modes, and the associated efficiencies can be controlled by changing various parameters such as the size of the cell patch, the length of the via line, the length of the feed line, the distance between the antenna element and the ground, and various other dimensions and layouts.

Unlike conventional antennas, the metamaterial antenna resonances are affected by the presence of a left handed (LH) mode. In general, the LH mode helps excite and better match the low resonances and can improve the matching at high resonances.

CRLH MTM antenna structures, as discussed in this document, include one or more permanently-formed conductive antenna elements on a substrate which are structured and electromagnetically coupled to one another to form a CRLH MTM structure. Other structures include permanently-formed electrically conductive tuning elements that are positioned at different locations from one another and from the permanently-formed antenna elements and are adjacent to respective permanently-formed conductive antenna elements to tune the resonant frequencies. In a post fabricated antenna device, these permanently-formed tuning elements can be modified using removable elements, such as zero ohm resistors, to provide flexibility to meet frequency requirements. Examples of these permanently-formed tuning elements include one or more tuning elements to tune the resonant frequencies. In the absence of such tuning elements, once an antenna is printed on a Printed Circuit Board (PCB), tuning of the resonant frequencies may require changes of the PCB hardware, e.g., rebuilding the PCB, remounting components and retesting the remounted components. The present technique utilizes the tuning elements and eliminates these costly and lengthy steps; and therefore the antenna can be tuned and matched to target bands after the antenna structure is formed on the PCB. Fine tuning of the antenna design, prototyping, repair and other processes that can occur after the antenna is printed on the PCB can be simplified by using these tuning elements.

More specifically, one or more of tuning elements in the examples in this document may be coupled to corresponding antenna elements by a connecting element which conducts electricity, such as a zero-ohm resistor or zero-ohm link that acts as a bridge, between the tuning element and the corresponding antenna element. The resonant frequencies can be increased or decreased without affecting their intrinsic efficiencies by using connecting elements to manipulate connections between the tuning elements and the corresponding antenna elements.

Hence, after the PCB device with printed antenna elements and tuning elements are fabricated and completed, a resonant frequency for an antenna can be tuned by connecting one or more of the unconnected tuning elements to the antenna or disconnecting one or more of the connected tuning elements from the antenna. This tuning technique based on pre-formed tuning elements provides tuning in frequency by changing only the connections of the tuning elements without requiring changing other circuit elements formed on the PCB or rebuilding the PCB.

In some implementations of metamaterial antennas with tuning elements, various circuit parameters that can be controlled to effectuate the desired tuning include. Examples of controllable parameters are shown in Table 1.0:

TABLE 1.0

Controllable Circuit Parameters used for Tuning

| Circuit Parameters | Description |
|---|---|
| The number and location of tuning elements. | |
| The spacing between a tuning element and the antenna element to be coupled. | This spacing determines the amount of a resonance shift, and can be determined by fabrication errors of the substrate being used, e.g., FR4 substrates for supporting the antenna components, and the associated tolerances to shifts in resonance caused by the dielectric and thickness tolerances of the substrate (FR4). |
| The size of the tuning element, which affects the amount of a resonance shift. | This parameter depends on the remaining available clearance between antenna structures that can fit the tuning element. |

In tunable metamaterial antenna devices according to some embodiments, resonant frequencies, matching of multiple modes, and associated efficiencies can be controlled by changing the size, length and/or shape of each element of the metamaterial antenna structure as well as layouts among different elements. Some examples of possible variations of the CRLH metamaterial antenna structure are illustrated in Table 2.0:

TABLE 2.0

Variations of the CRLH MTM Antenna Structure

| Structure | Possible variations to structure |
|---|---|
| Via line and feed line | Can have a variety of geometrical shapes and lengths such as but not limited to rectangular, irregular, spiral, meander or combination of different shapes. |
| Cell patch | Can have a variety of geometrical shapes such as but not limited to rectangular, polygonal, irregular, circular, oval, spiral, meander or combination of different shapes. |
| Non-planar substrate | Can be used to accommodate various parts in different planes for foot-print reduction. |
| Multiple cells | Can be cascaded in series creating a multi-cell 1D structure; and can be cascaded in orthogonal directions generating a 2D structure. |
| Single feed line | Can be configured to feed multiple cell patches. |
| Meandered stub | Can be added and extended from the feed line to introduce an extra resonance, especially at low frequencies, for example, below 1 GHz; the meandered stub can have different geometrical shapes such as but not limited to rectangular or spiral (circular, oval, and other shapes); this meandered stub can be placed on the top, mid or bottom layer, or a few millimeters above the substrate. |

Any combination of the above, as well as other variations, may be implemented in an metamaterial antenna device.

These CRLH MTM antenna structures can be fabricated by using a conventional FR-4 substrate or a Flexible Printed Circuit (FPC) board. Examples of other fabrication techniques include thin film fabrication technique, System On Chip (SOC) technique, Low Temperature Co-fired Ceramic (LTCC) technique, and Monolithic Microwave Integrated Circuit (MMIC) technique.

In some implementations of antenna structures, a grounded CPW is used to deliver power to the feed line. Other schemes to feed the antenna include the use of a conventional CPW line without a ground plane on a different layer, a probed patch, a cable directly launched to the beginning of the feed line, or different types of Radio Frequency (RF) feed lines.

Figure 1B:
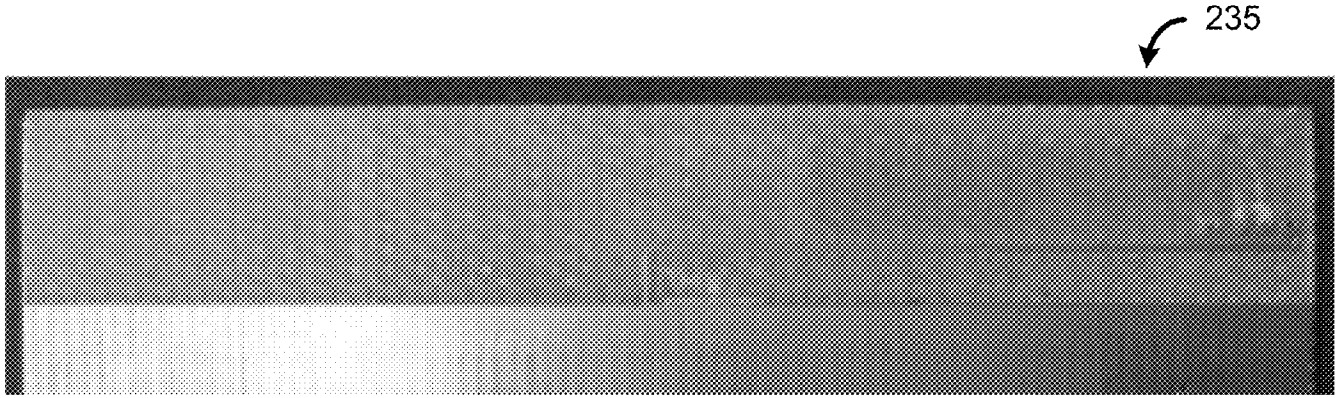
FIG. 1B illustrates a photograph of a bottom view of a bottom layer of the CRLH MTM antenna shown in FIG. 1A.
Figure 2A:
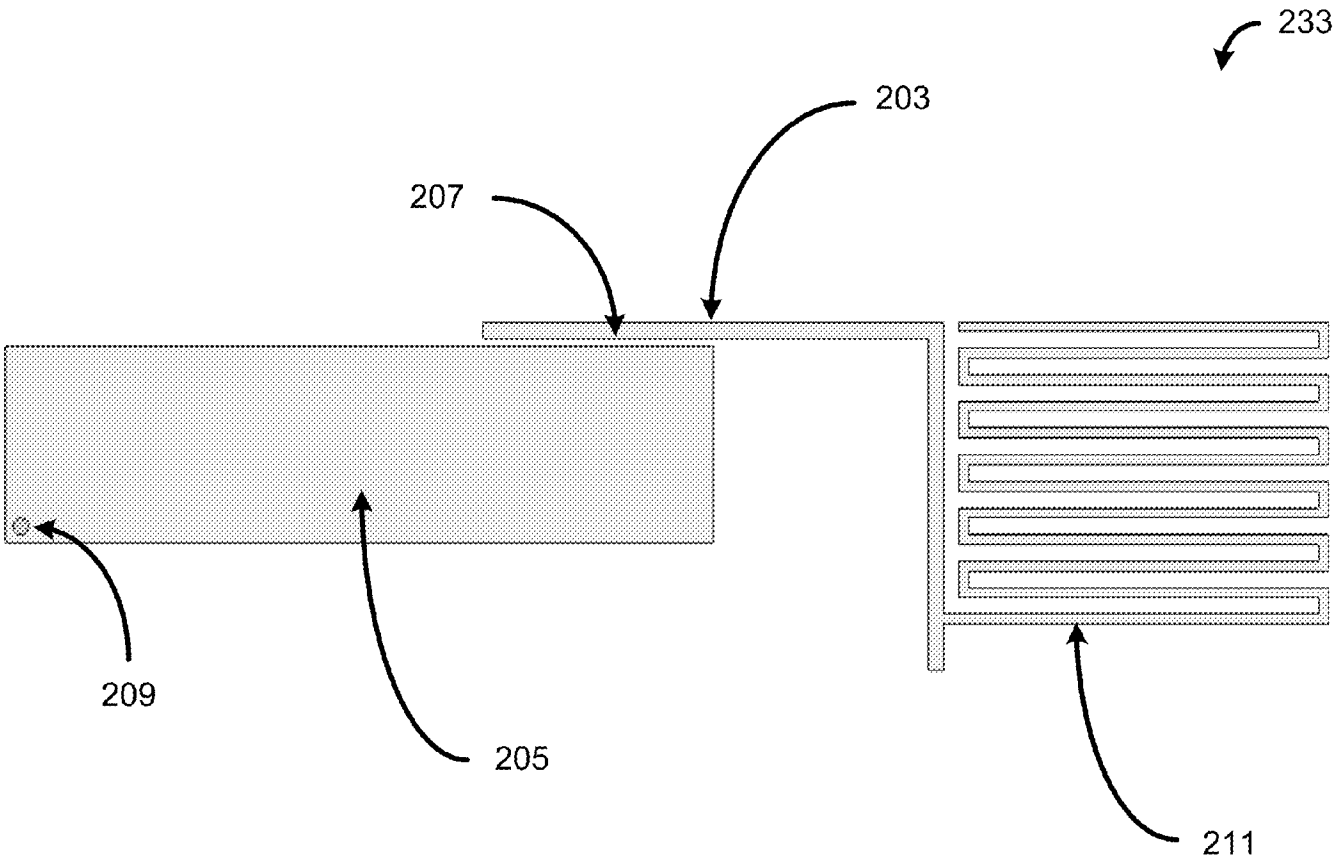
FIG. 2A illustrates a computer-generated top view of the top layer of the CRLH MTM antenna shown in FIG. 1A.
Figure 2B:
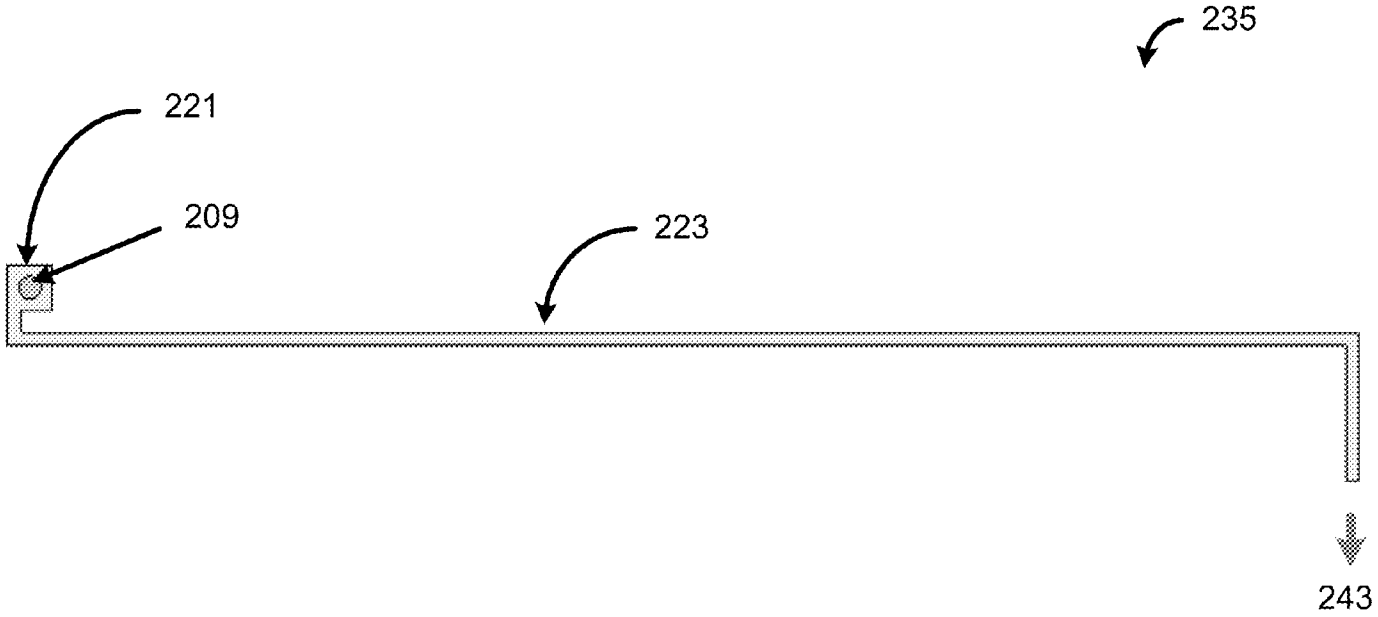
FIG. 2B illustrates a computer-generated top view of the bottom layer of the CRLH MTM antenna shown in FIG. 1B.
Figure 2C:
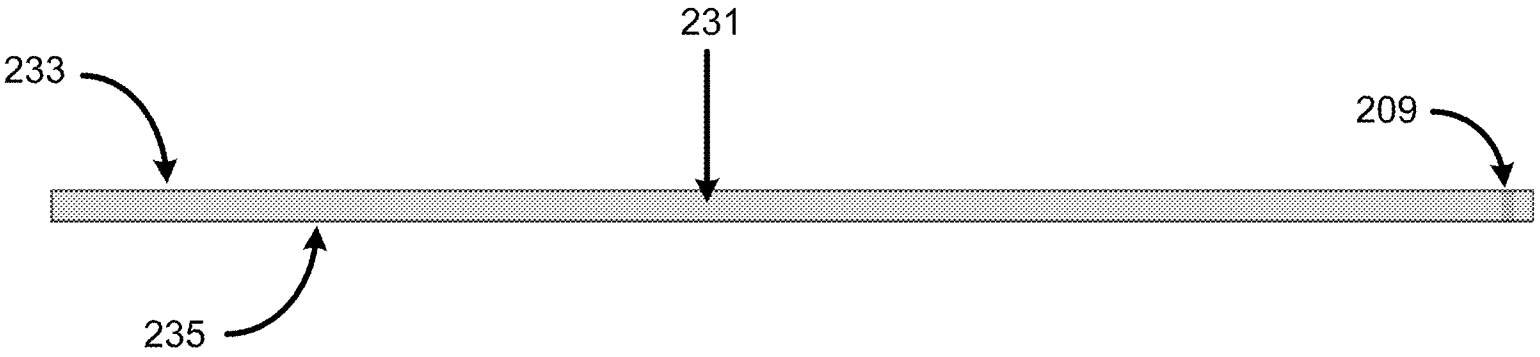
FIG. 2C illustrates a computer-generated side view of the CRLH MTM antenna shown in FIGS. 2A-2B.
Figure 2D:
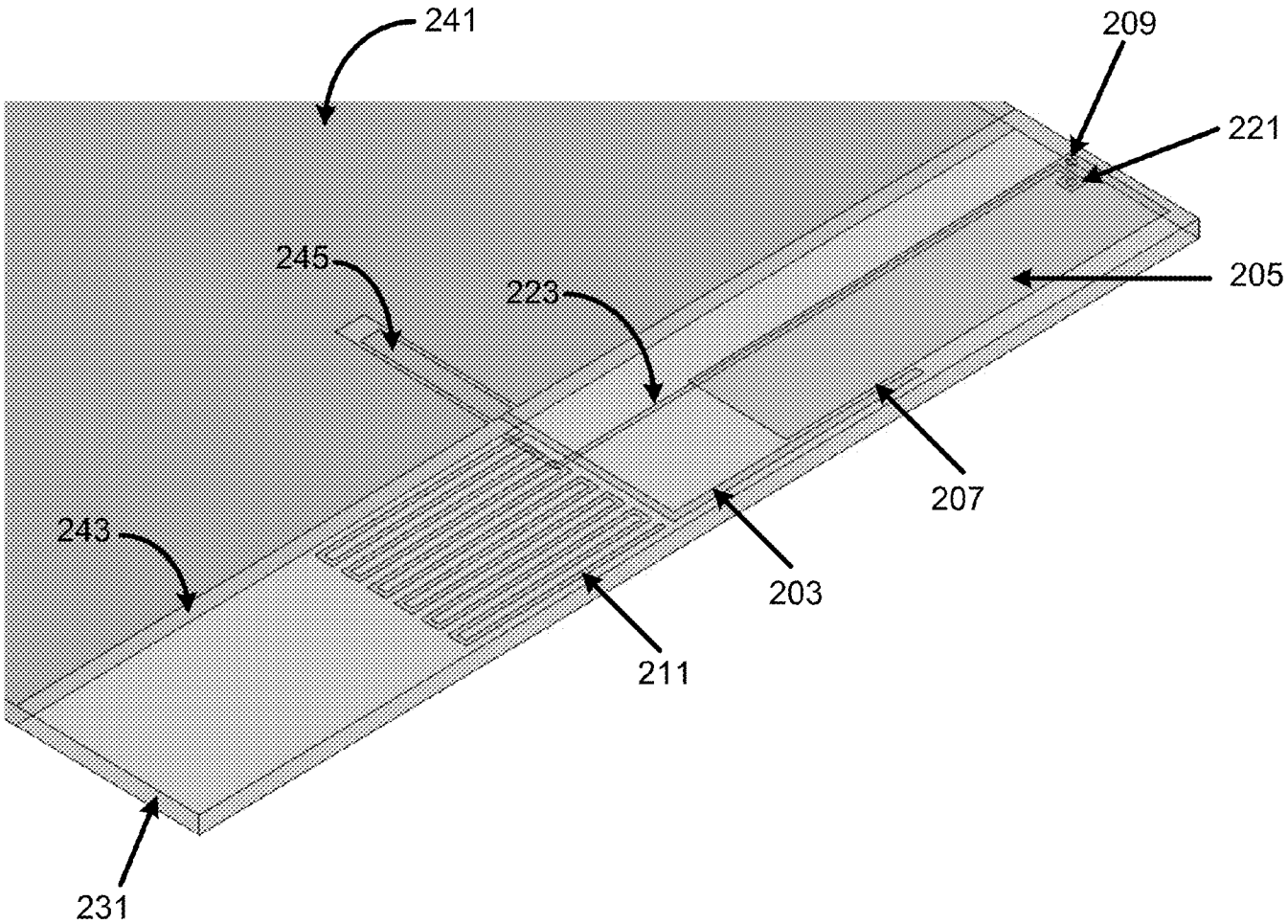
FIG. 2D illustrates a computer-generated 3D view of the CRLH MTM antenna shown in FIGS. 2A-2B.

FIGS. 1A and 1B illustrate photographs of an actual sample of a first CRLH MTM antenna structure without tuning elements, referred to as Antenna 1, which is fabricated on an FR-4 substrate. A top view of a top layer 233 is shown in FIG. 1A, and a bottom view of a bottom layer 235 is shown in FIG. 1B. FIGS. 2A-2D illustrate multiple computer-generated views of the CRLH MTM antenna shown in FIGS. 1A-1B. A computer-generated top view of the top layer 233 is illustrated in FIG. 2A, a computer-generated top view of the bottom layer 235 is shown in FIG. 2B, and computer-generated side and 3D views are shown in FIGS. 2C-2D, respectively. Referring to FIGS. 2A-2D, a feed line 203 is formed in the top layer 233, and the distal end of the feed line 203 is electromagnetically coupled to a cell patch 205, also formed in the top layer 233, through a coupling gap 207. Power is delivered to the cell patch 205 from the grounded CPW feed 245 through the feed line 203 and the coupling gap 207. A via 209 is formed in the substrate 231 to connect the cell patch 205 in the top layer 233 and a via pad 221 in the bottom layer 235. A via line 223 stems from the bottom ground plane 243 and extends until it connects to the via pad 221. The cell patch 205 along with the via 209, the via pad 221, the feed line 203 and the via line 223 constitute a CRLH unit cell. Stemming from the feed line 203 in the top layer 233 is a meandered stub 211 that extends away from the top ground plane 241. Such an metamaterial antenna structure is different from a slot antenna structure because the feed line 203 and the cell patch 205 are separated by the coupling gap 207.

A summary of individual element parts of Antenna 1 is provided in the Table 3.0 shown below.

TABLE 3.0

Antenna 1 - CRLH MTM Antenna (No Tuning Elements)

| Elements | | Description | Location |
|---|---|---|---|
| Antenna Elements | | Comprises a Cell coupled to a Feed Line 203 through a coupling gap 207 and then to a CPW Feed 245. A Meandered Stub 211 is attached to the Feed Line 203. All of these elements are located in the top and bottom layers 233, 235 of the substrate 231. | Top Layer 233 & Bottom Layer 235 |
| CPW Feed 245 | | Connects the Feed Line 203 with an antenna feed point. | Top Layer 233 |
| Feed Line 203 | | Delivers power to the Cell by coupling through the coupling gap 207 and also to the Meandered Stub 211. | Top Layer 233 |
| Meandered Stub 211 | | A thin trace that stems from the Feed Line 203 and extends away from the top ground 241. | Top Layer 233 |
| Cell | Cell Patch 205 | Rectangular shape. | Top Layer 233 |
| | Via 209 | Cylindrical shape connecting the Cell Patch 205 with a Via Line 223 through a Via Pad 221. | |
| | Via Pad 221 | A pad connecting the Via 209 to the Via Line 223. | Bottom Layer 235 |
| | Via Line 223 | A thin trace that connects the Via Pad 221, hence the Cell Patch 205, to the bottom ground 243. | Bottom Layer 235 |

In an alternative configuration, the via line 223 on the top layer 233 may be directly connected to the cell patch 205 without the via. In yet another variation, the via line 223 on a third layer (not shown) may be connected to the cell patch 205 through a via formed between the bottom layer 235 and the third layer. The top and bottom layers 233, 235 as well as the additional third layer can be interchangeable in Antenna 1.

Examples of design parameter values used for implementing Antenna 1 are provided in Table 4.0 below.

TABLE 4.0

Antenna 1 - Design Parameter Examples

| Antenna 1 Parameter | Design examples for Antenna 1 |
|---|---|
| The size of the PCB. | Approximately 60 mm wide and 100 mm long, with 1 mm thickness. The PCB material can be FR4 with a dielectric constant of 4.4. |
| Overall height and length of antenna. | The antenna height measures approximately 10.5 mm from the edge of the top ground, and its total length is approximately 43 mm. |
| The feed line. | Approximately 25 mm in length and approximately 0.5 mm in width. |
| The coupling gap. | Approximately 0.25 mm in width. |
| The cell patch. | Rectangular shape, about 23 mm in length and about 5.9 mm in width. |
| The via line. | Approximately 33.5 mm in total length, and has a width of approximately 0.3 mm. |
| The via pad. | Shape of a square, measuring approximately 1 mm by 1 mm. |

A metamaterial antenna structure may be implemented based on the above design parameter values to generate efficient radiating modes in the 800 MHz to 900 MHz bands and around 2 GHz, which are used in wireless networks and services for cell phones and other applications.

Figure 3A:
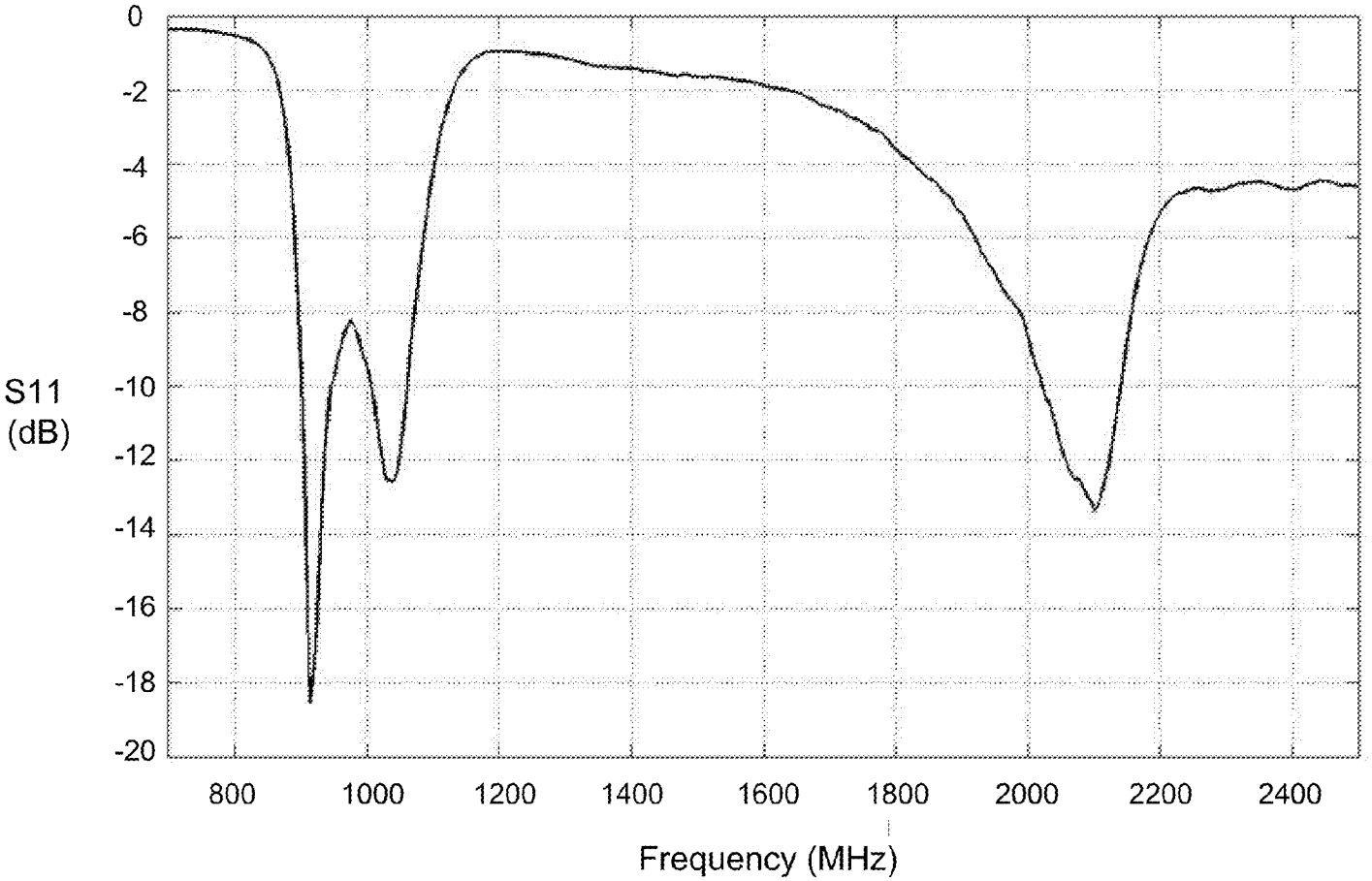
FIG. 3A illustrates a measured return loss of Antenna 1.
Figure 3B:
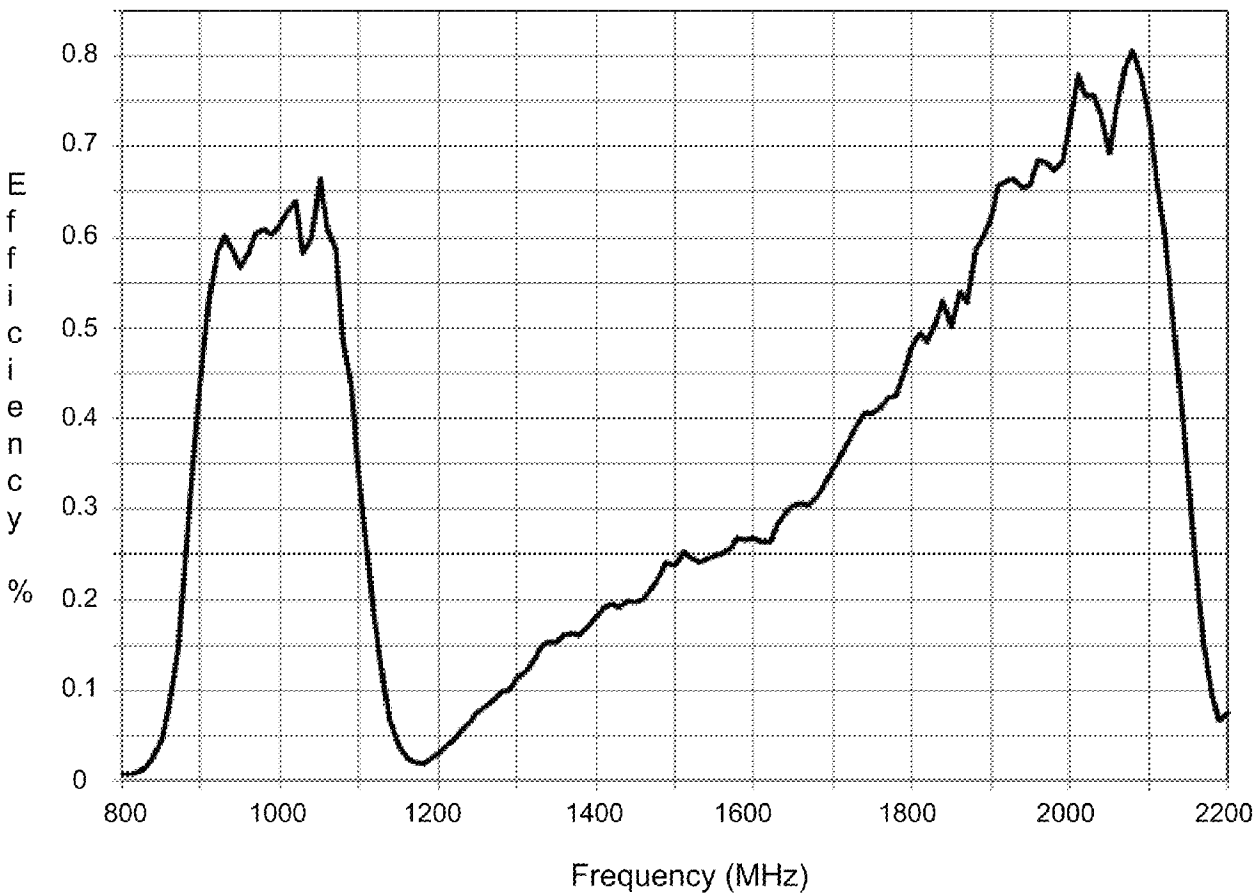
FIG. 3B illustrates a measured efficiency of Antenna 1.

Antenna 1 may have two frequency resonances in the low frequency band as can be seen from the measured return loss in FIG. 3A. The first resonance is centered at approximately 920 MHz and the second resonance is centered at approximately 1020 MHz. These two resonances combined make up the low frequency band with a bandwidth of about 200 MHz at −6 dB return loss. The first resonance that is the lowest in frequency is an LH resonance, which may be controlled by the layout and shape of the cell patch and the corresponding via line structure, and the gap between the cell patch and the feed line. The second resonance is an RH resonance and may be controlled by the length of the meandered stub stemming from the feed line. The third resonance makes up the high band for this antenna structure. This third resonance is also an RH resonance and is centered at approximately 2.1 GHz with a bandwidth of about 300 MHz at −6 dB. This resonance is due to a monopole mode that is controlled by the physical length of the feed line and also by the relative electrical length, determined by the length of the cell patch and via line, which is added when the feed line couples through the coupling gap to the cell patch. As seen in FIG. 3A, two major bands, a "low" frequency band from ~800 MHz to ~900 MHz and a "high" frequency band from ~2 GHz, can be defined, making this antenna structure suitable for penta-band cell phone applications. Measured efficiency results associated with each band can be seen in FIG. 3B.

Figure 4A:
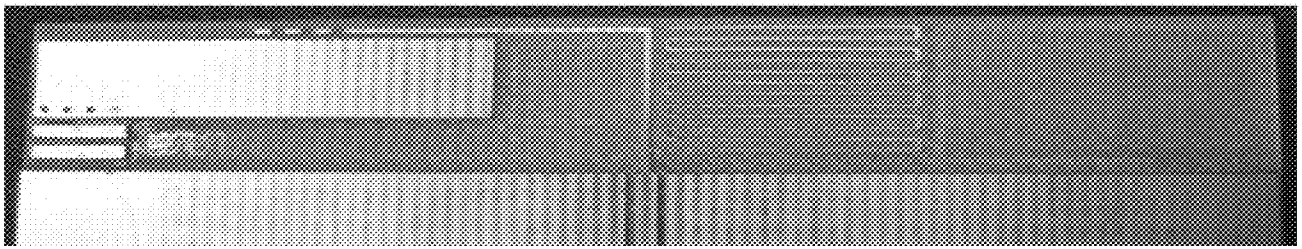
FIG. 4A illustrates a photograph of a top view of a top layer of an CRLH MTM antenna (Antenna 2) according to an example embodiment.
Figure 4B:
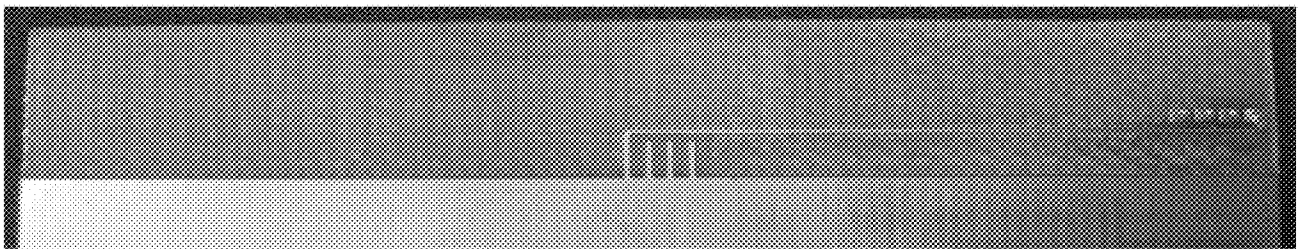
FIG. 4B illustrates a photograph of a bottom view of a bottom layer of the CRLH MTM antenna shown in FIG. 4A.
Figure 5A:
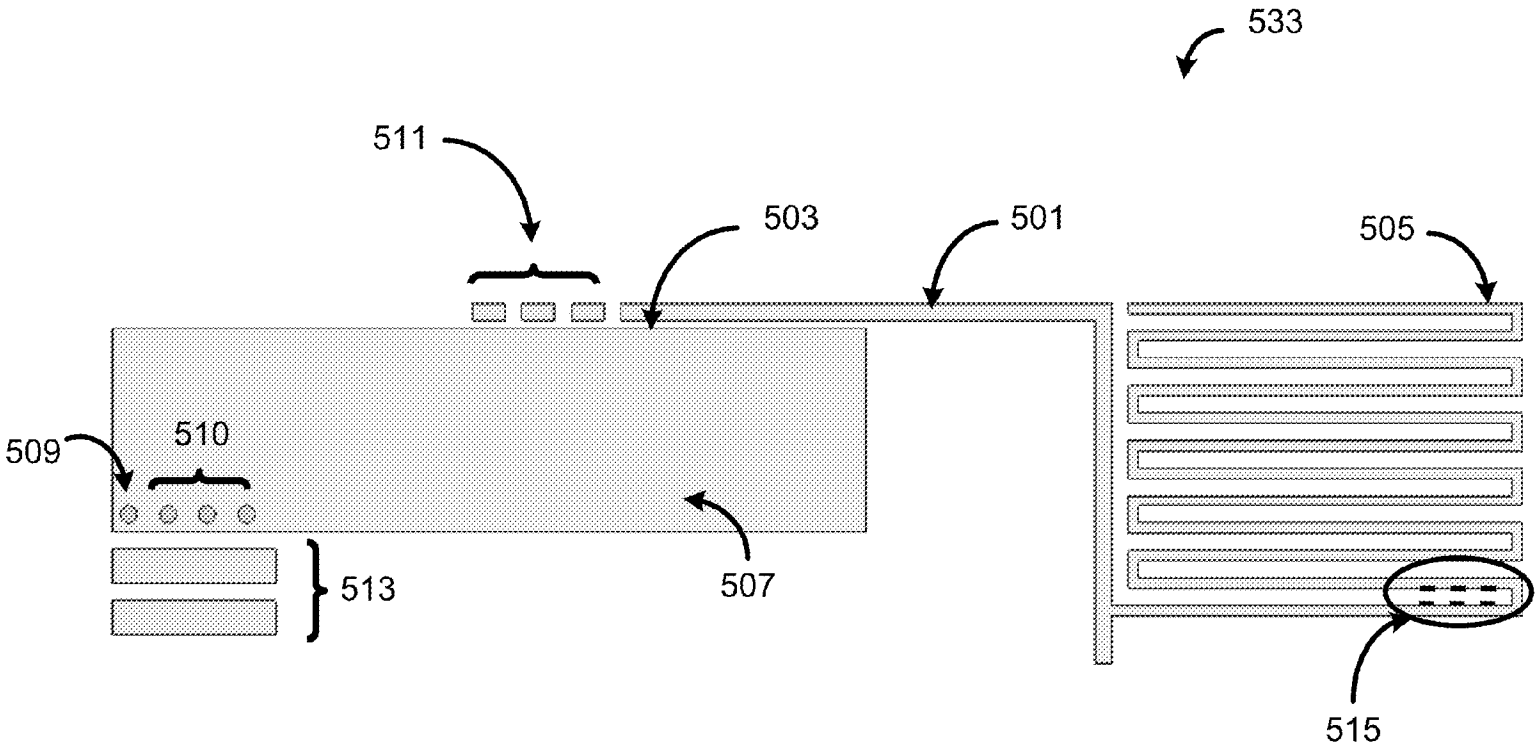
FIG. 5A illustrates a computer-generated top view of the top layer of the CRLH MTM antenna shown in FIG. 4A.
Figure 5B:
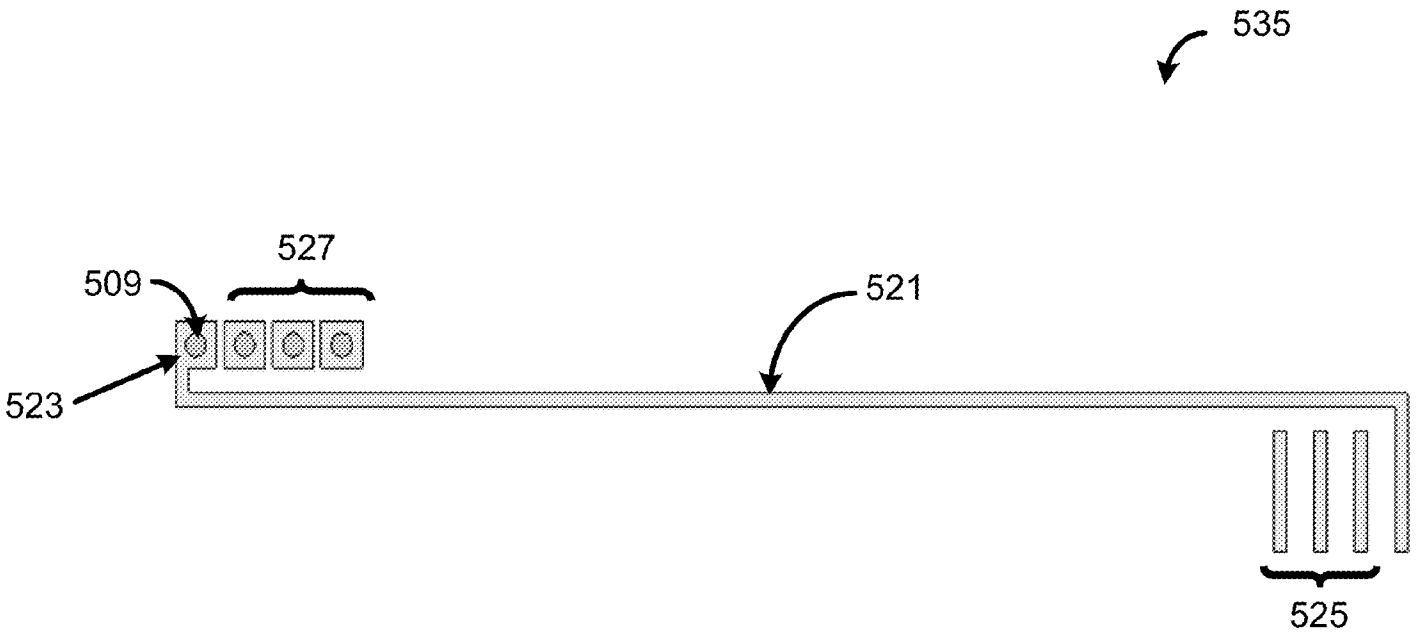
FIG. 5B illustrates a computer-generated top view of the bottom layer of the CRLH MTM antenna shown in FIG. 4B.
Figure 5C:
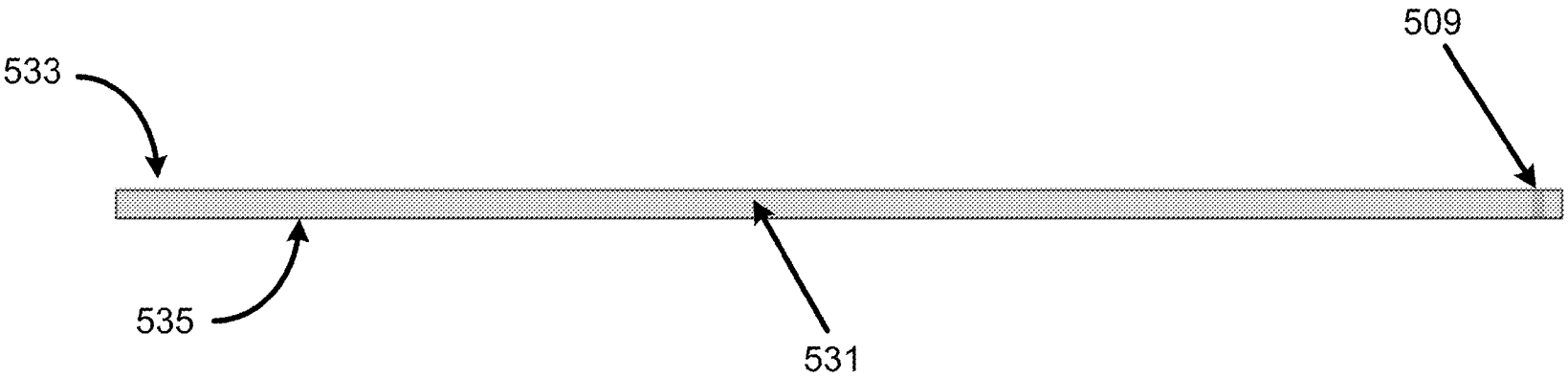
FIG. 5C illustrates a computer-generated side view of the CRLH MTM antenna shown in FIGS. 5A-5B.
Figure 5D:
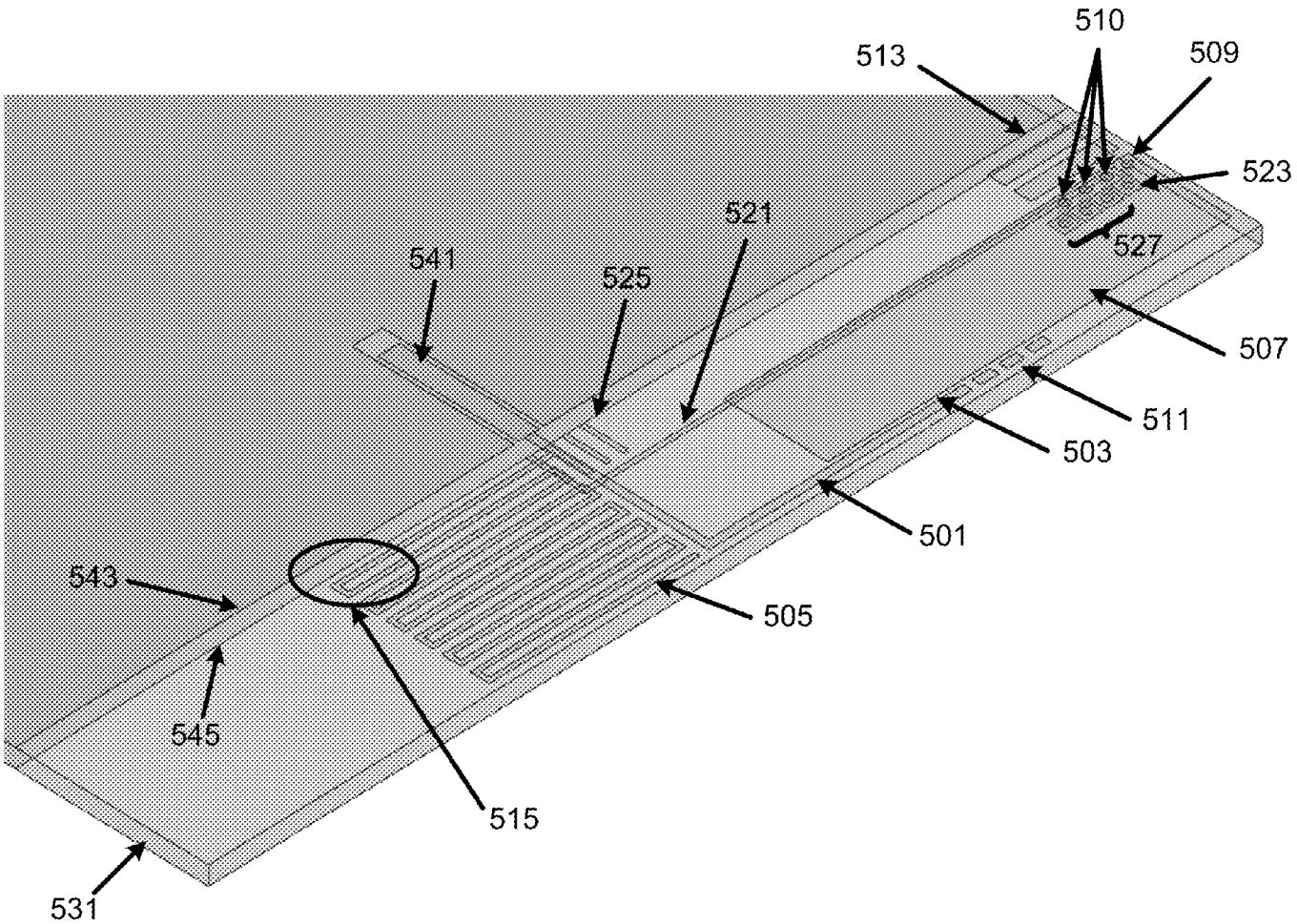
FIG. 5D illustrates a computer-generated 3D view of the CRLH MTM antenna shown in FIGS. 5A-5B.

FIGS. 4A and 4B illustrate photographs of an actual sample of a second CRLH MTM antenna structure with tuning elements, referred to as Antenna 2, which is fabricated on an FR-4 substrate. Antenna 2 represents a CRLH MTM antenna structure which is similar to Antenna 1 and includes tuning elements added at selected locations. In general, these tuning elements are located close to corresponding antenna elements. A top view of a top layer 533 is shown in FIG. 4A, and a bottom view of a bottom layer 535 is shown in FIG. 4B. FIGS. 5A-5D illustrate multiple computer-generated views of the CRLH MTM antenna shown in FIGS. 4A-4B. A computer-generated top view of the top layer 533 is illustrated in FIG. 5A, a computer-generated top view of the bottom layer 535 is shown in FIG. 5B, and computer-generated side and 3D views are shown in FIGS. 5C-5D, respectively. Top and bottom grounds 543,545 and the CPW feed 541 of FIG. 5D are omitted in FIGS. 5A-5C, for simplicity.

A summary of individual elements of Antenna 2 is provided in the Table 5.0 shown below.

TABLE 5.0

Antenna 2 - CRLH MTM Antenna with Tuning Elements

| Elements | | Description | Location |
|---|---|---|---|
| Antenna Elements | | Comprises a Cell coupled to a Feed Line 501 through a coupling gap 503 and then to a CPW Feed 541. A Meandered Stub 505 is attached to the Feed Line 501. All of these elements are located in the top and bottom layers 533, 535 of the substrate 531. | Top Layer 533 & Bottom Layer 535 |
| CPW Feed 541 | | Connects the Feed Line 501 with an antenna feed point. | Top Layer 533 |
| Feed Line 501 | | Delivers power to the Cell by coupling through the coupling gap 503 and also to a Meandered Stub 505. | Top Layer 533 |
| Meandered Stub 505 | | A thin trace that stems from the Feed Line 501 and extends away from the top ground 543. | Top Layer 533 |
| Cell | Cell Patch 507 | Rectangular shape. | Top Layer 533 |
| | Via 509 | Cylindrical shape connecting the Cell Patch 507 with a Via Line 521 through a Via Pad 523. | |

TABLE 5.0-continued

Antenna 2 - CRLH MTM Antenna with Tuning Elements

| Elements | | Description | Location |
|---|---|---|---|
| | ViaPad 523 | A pad that connects the Via Line 521 to the Via 509. | Bottom Layer 535 |
| | Via Line 521 | A thin trace that connects the Via Pad 523, hence the Cell Patch 507, to the bottom ground 545. | Bottom Layer 535 |
| Tuning Elements | Feed Line Tuning Elements 511 | Small rectangular patches located close to the distal end of the Feed Line 501 and the Cell Patch 507. | Top Layer 533 |
| | Cell Patch Tuning Elements 513 | Rectangular patches located close to one end of the Cell Patch 507. | Top Layer 533 |
| | Via Line Tuning Elements 525 | Rectangular traces located close to the proximal end of the Via Line 521. | Bottom Layer 535 |
| | Via Pad Tuning Elements 527 | Square patches and the respective vias 510 located close to the distal end of the Via Line 521 close to the original Via Pad 523. | Bottom Layer 535 |
| | Meandered Stub Tuning Elements 515 | Small pads located right before the first turn of the Meandered Stub 505. | Top Layer 533 |

In various implementations, some examples for the parameter values of the tuning elements in Antenna 2 are listed in Table 6.0 shown below:

TABLE 6.0

Antenna 2 - Design Parameter Examples

| Antenna 2 Parameter | Design examples for Antenna 2 |
|---|---|
| Three feed line tuning elements 511. | Each feed line tuning element is about 0.5 mm wide by 1 mm long, along the edge of the cell patch 507. The first feed line tuning element is about 0.5 mm away from the edge of the distal end of the feed line 501. The second feed line element is separated from the first one by about 0.5 mm, and the third feed line element is separated from the second one by about 0.5 mm. |
| Two cell patch tuning elements 513. | Each cell patch tuning element is about 1 mm wide by 5 mm long. The first cell patch tuning element is about 0.5 mm away from the bottom edge of the cell patch 507. The second cell patch tuning element is separated from the first one by about 0.5 mm. |
| Meandered stub tuning elements 515. | The meandered stub tuning element represent pairs of small pads attached to the meandered stub 505 for receiving connecting elements, and are placed close to the first turn of the meander. The first pair is located about 1 mm away from the first turn, and the second pair is located about 1 mm away from the first one, and so on. Alternatively, the connecting elements can be directly attached to the meandered stub |

TABLE 6.0-continued

| Antenna 2 - Design Parameter Examples | |
|---|---|
| Antenna 2 Parameter | Design examples for Antenna 2 |
| | 405 instead of using the small pads. |
| Three via line tuning elements 525 | Each via line tuning element is about 0.3 mm wide by 2.55 mm long. The first via line tuning element is placed at about 0.7 mm away from the side edge of the proximal end of the via line 521. The second via line tuning element is separated from the first one by about 0.7 mm, and the third via line tuning element is separated from the second one by about 0.7 mm. The spacing between the via line tuning elements 525 and the edge of the via line 521 portion after the first bend is about 0.5 mm. |
| Three via pad tuning elements 527 | Each via pad tuning element is about 1 mm wide by 1 mm long, placed close to the original via pad 523. The via pad tuning elements 527 include respective vias 510. The first via pad element is separated from the original via pad by about 0.2 mm, the second via pad element is separated from the first one by about 0.2 mm, and the third via pad element is separated from the second one by about 0.2 mm. |

Figure 6A:
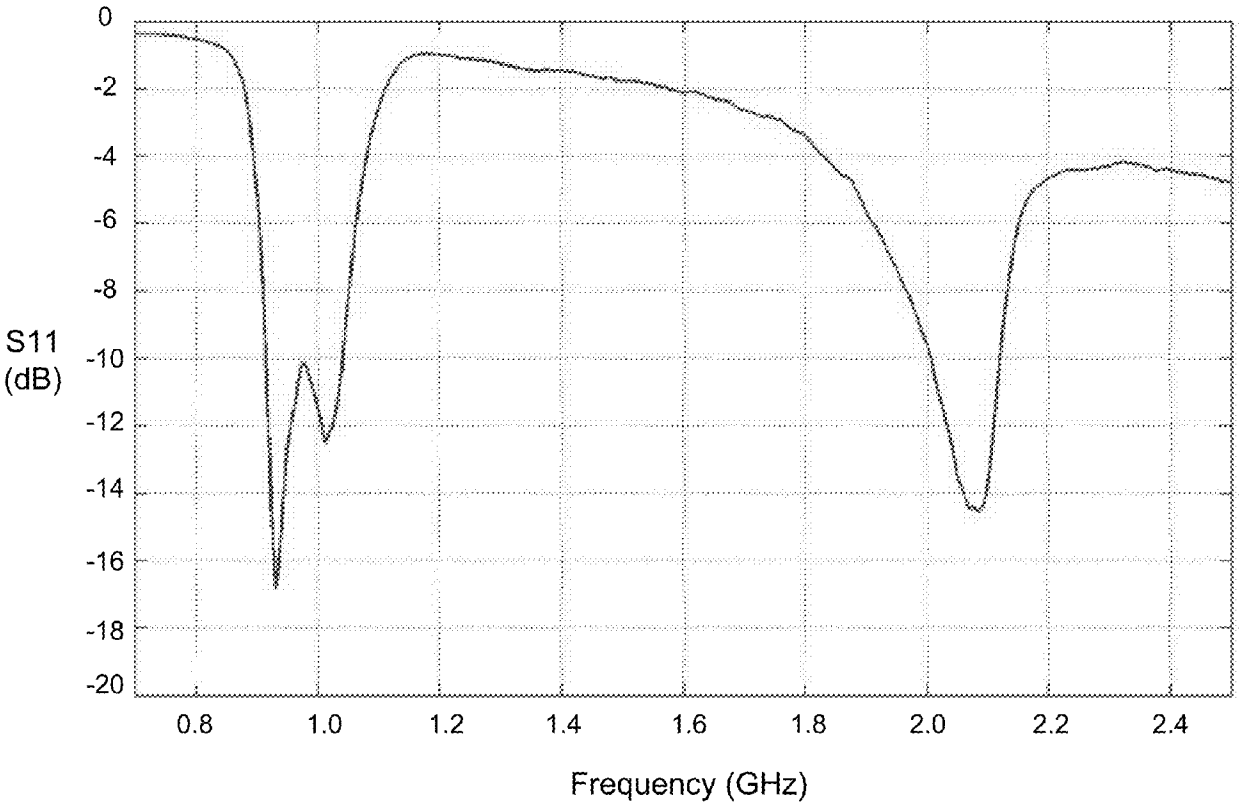
FIG. 6A illustrates a measured return loss of Antenna 2.
Figure 6B:
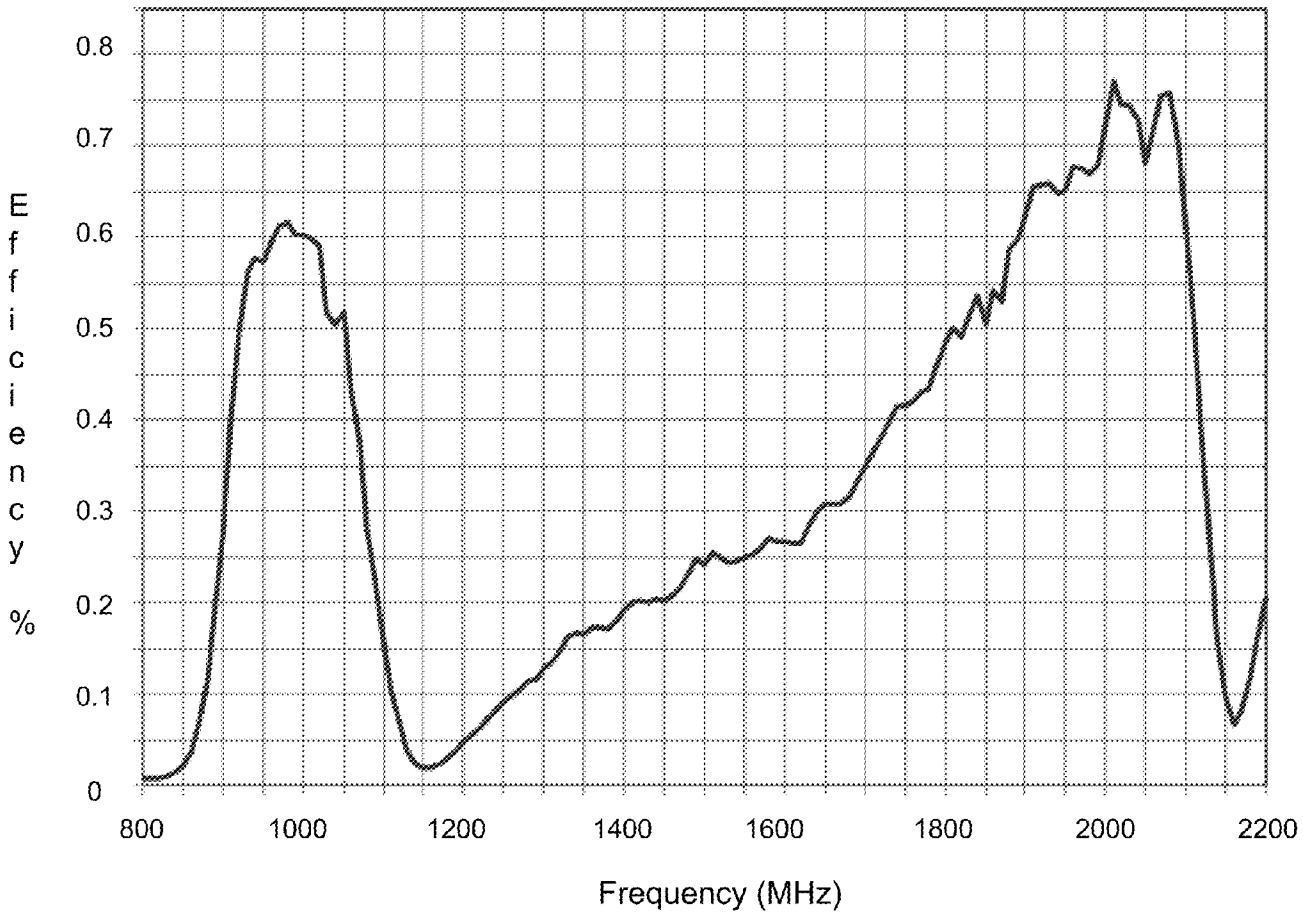
FIG. 6B illustrates a measured efficiency of Antenna 2.

Antenna 2 can be implemented to have the same two frequency bands as Antenna 1. The two frequency bands for Antenna 2 have the same three resonances as those in Antenna 1, as evidenced by the measured return loss in FIG. 6A. Each individual resonance can be originated and controlled in the same manner as in Antenna 1, and the center frequencies are substantially the same as those in Antenna 1. Measured efficiency results associated with each band can be seen from FIG. 6B.

Figure 7A:
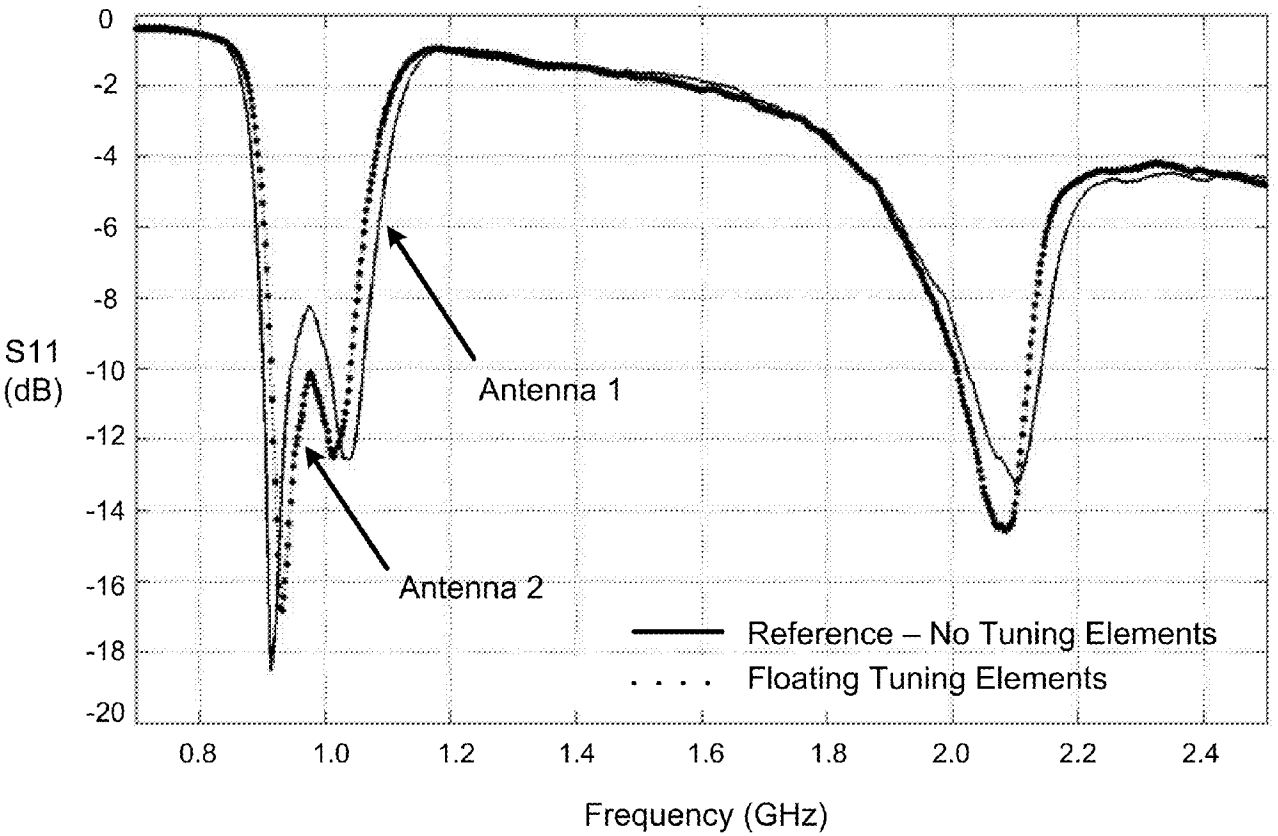
FIG. 7A illustrates a measured return loss comparison between Antenna 1 and Antenna 2.
Figure 7B:
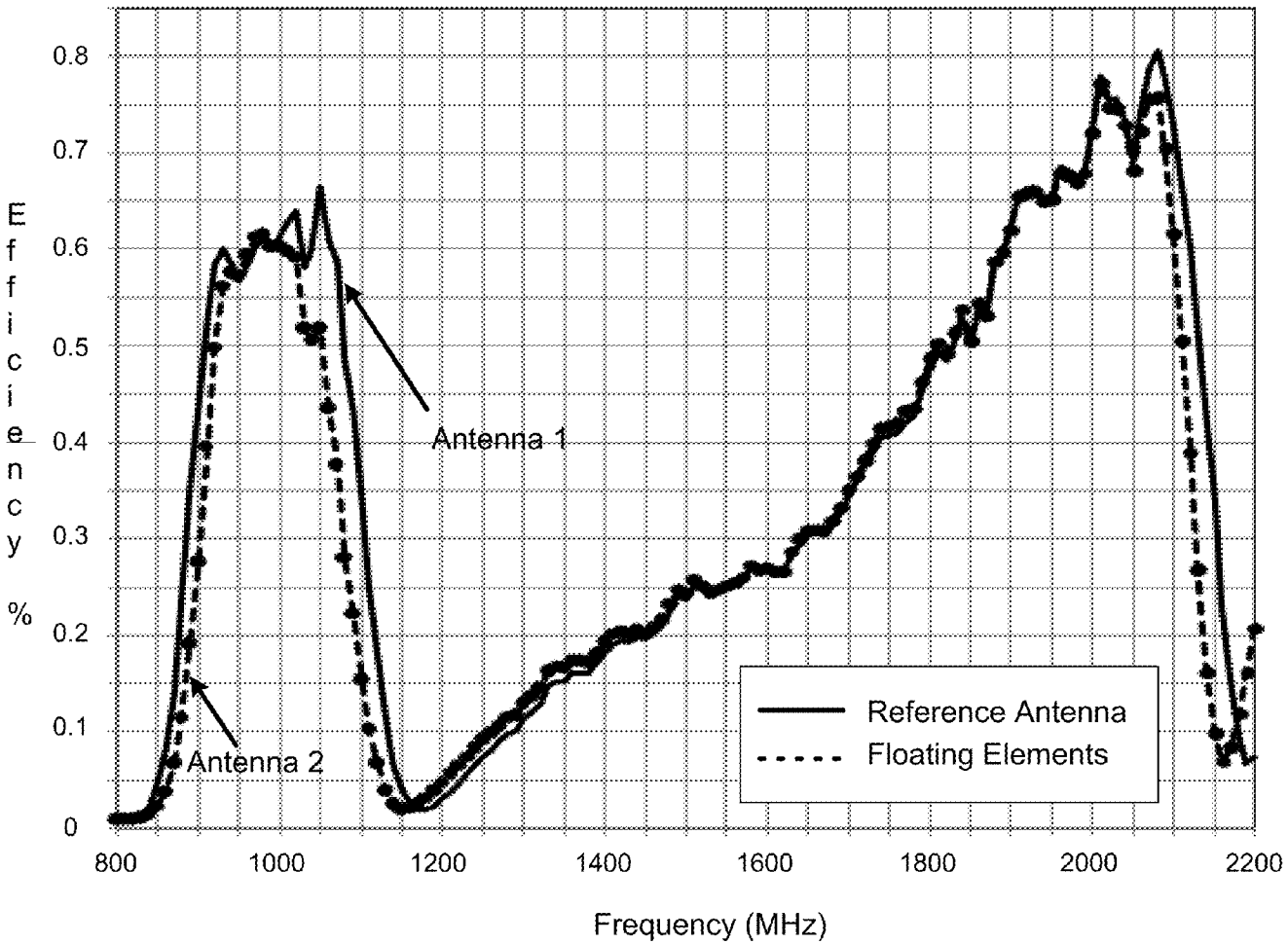
FIG. 7B illustrates a measured efficiency comparison between Antenna 1 and Antenna 2.

FIG. 7A shows the measured return loss results of Antenna 1 and Antenna 2, indicated by the solid line and dotted line with solid circles, respectively. FIG. 7B shows the measured efficiency results of Antenna 1 and Antenna 2, indicated by the solid line and dashed line with solid circles, respectively. As can be seen in FIGS. 7A and 7B, the addition of the tuning elements has no significant impact on the resonant frequencies or the associated efficiencies.

Different type tuning elements for tuning metamaterial antenna structures can be implemented and some examples include feed line tuning elements, cell patch tuning elements, meandered stub tuning elements, via line tuning elements, and via pad tuning elements. In a particular metamaterial antenna structure, any one or a combination two or more of different types of tuning elements can be used to achieve the desired tuning and antenna characteristics. Tuning elements may be tuned by utilizing a conductive connector to change the physical characteristics associated with each tuning element. Such changes in physical characteristics in turn impact resonant frequencies and efficiencies in the low and high bands.

Feed Line Tuning Elements

Feed line tuning elements can be located close to the distal end of the feed line of Antenna 2. When connected by connecting elements, such as zero ohm resistors acting as bridges, feed line tuning elements can be used to effectively change the length of the feed line. In the example above, the RH resonance near 2 GHz in the high band is due to the monopole mode, which is controlled by the length of the feed line. Therefore, the feed line tuning elements provide means for tuning the resonant frequency of the RH monopole mode resonance in the high band.

Figure 8A:
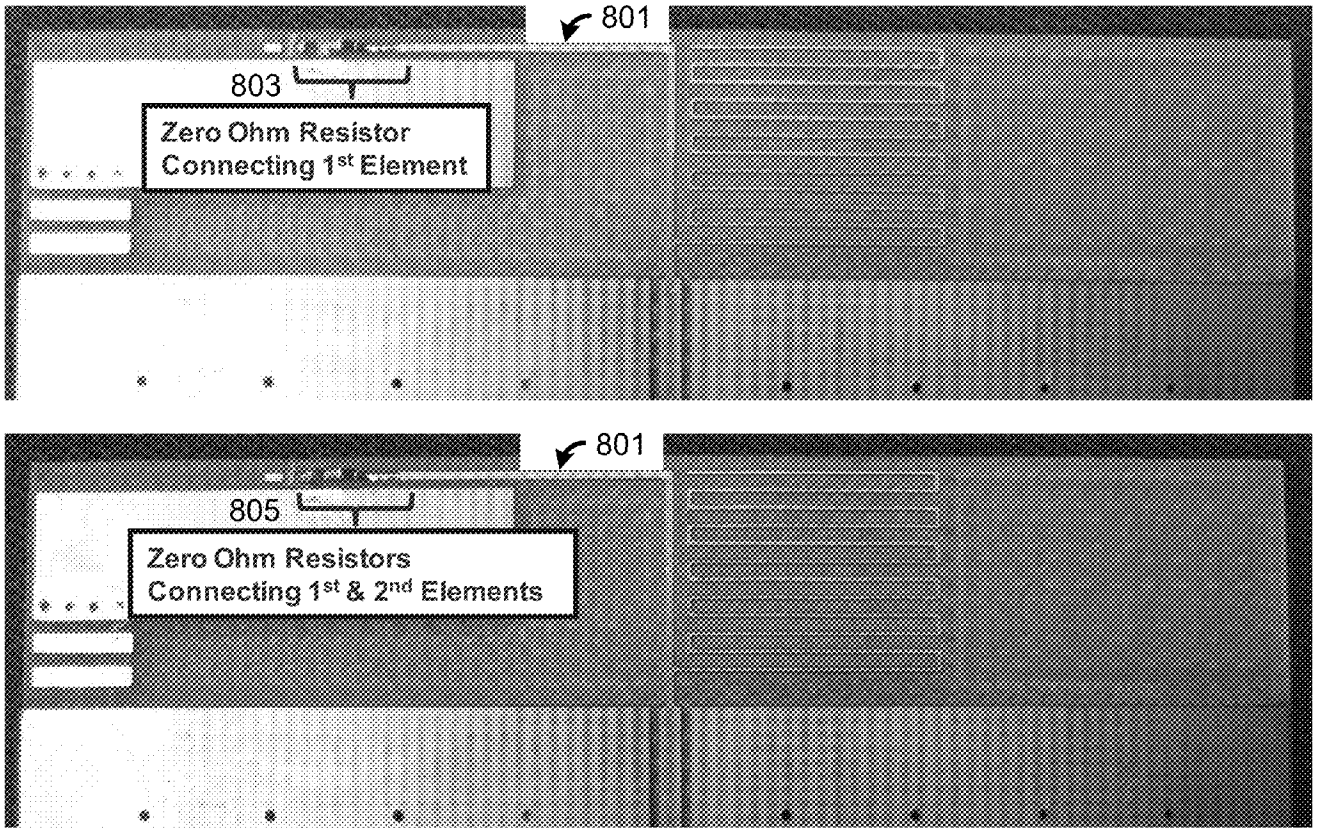
FIG. 8A illustrates a photograph of feed line tuning elements connected in Antenna 2.

FIG. 8A shows one photograph (top) for the case of a first feed line tuning element being connected to a feed line 801 by a zero ohm resistor 803, and another photograph (bottom) for the case of the first tuning element being connected to the feed line 801 by a zero ohm resistor and a second feed line tuning element being connected to the first one by another zero ohm resistor 805.

Figure 8B:
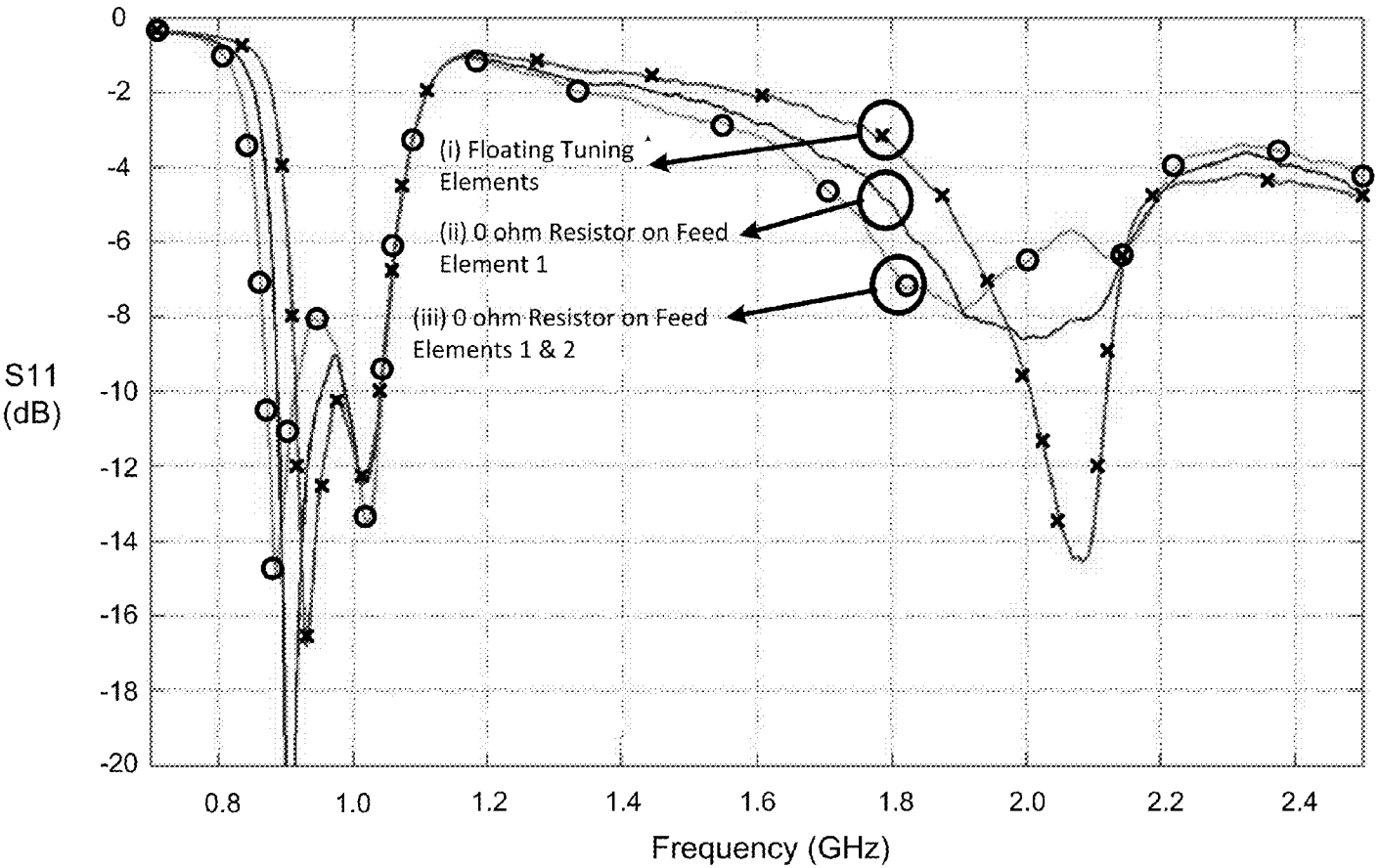
FIG. 8B illustrates a measured return loss of the feed line tuning elements connected as shown in FIG. 8A.

FIG. 8B shows the measured return loss results for the cases of: (i) all feed line tuning elements being floated (Antenna 2); (ii) the first tuning element being connected to the feed line by a zero ohm resistor; and (iii) the first tuning element being connected to the feed line by a zero ohm resistor and the second tuning element being connected to the first one by another zero ohm resistor. As the number of connected feed line tuning elements increases, the effective length of the feed line increases, thereby decreasing the RH monopole mode resonant frequency in the high band as evidenced by FIG. 8B. As the number of connected feed line tuning elements increases, the LH resonant frequency in the low band also decreases, but by a smaller scale. This may be due to an increase in the capacitive coupling through the gap to the feed line.

Figure 8C:
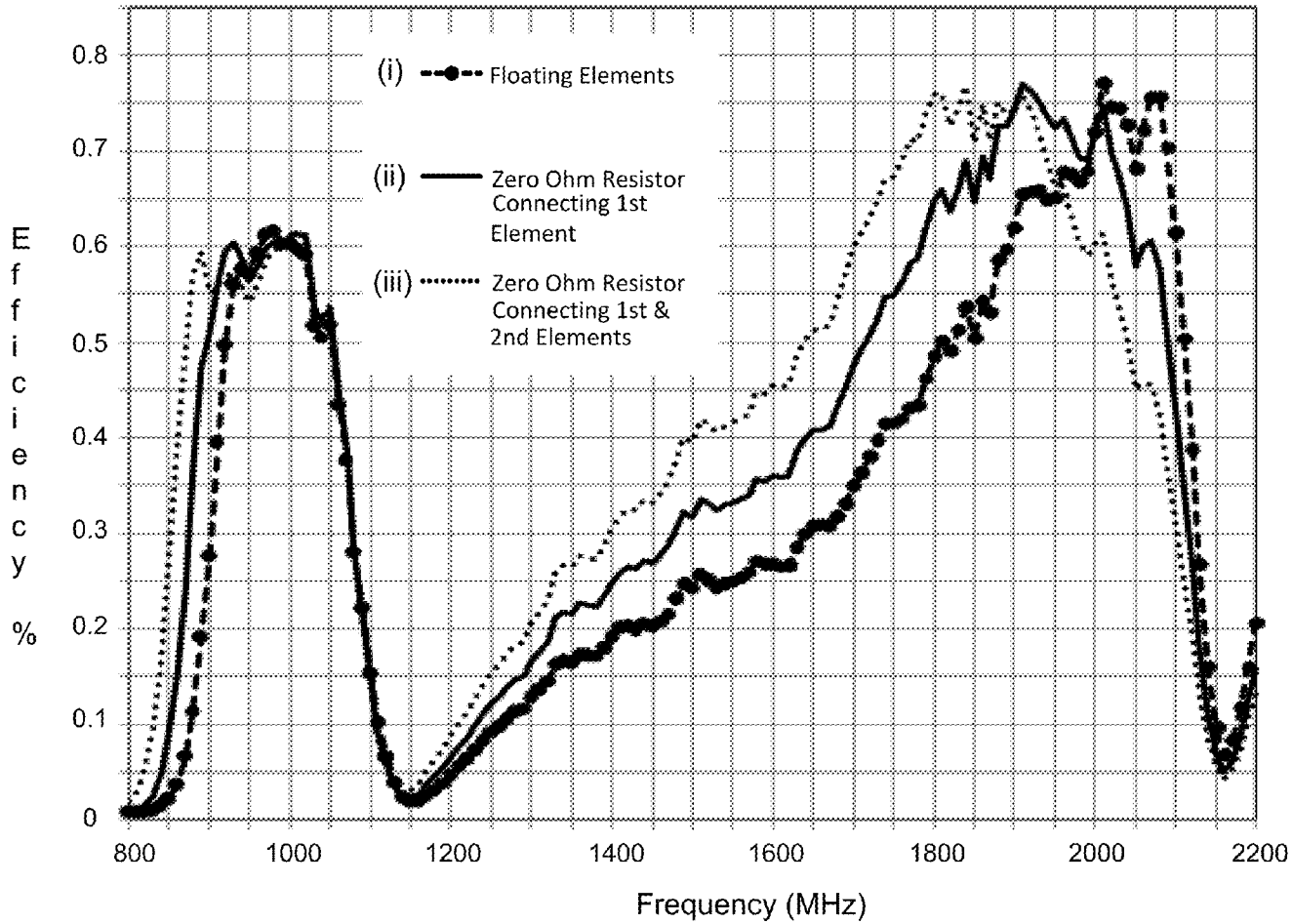
FIG. 8C illustrates a measured efficiency of the feed line tuning elements connected as shown in FIG. 8A.

FIG. 8C shows the measured efficiency results for the above three cases (i), (ii) and (iii), indicated by the dashed line with solid circles, solid line and dotted line, respectively. As can be seen from FIG. 8C, the peak efficiency points shift corresponding to the resonant frequencies as the number of connected feed line tuning elements changes.

Cell Patch Tuning Elements

Cell patch tuning elements can be located close to one end of the cell patch of Antenna 2. When connected by connecting elements such as zero ohm resistors acting as bridges, cell patch tuning elements can be used to effectively change the size, shape and dimensions of the cell patch. As mentioned earlier, the LH resonance in the low band is controlled by the layout and shape of the cell patch among other factors. Therefore, the cell patch tuning elements provide means for tuning the resonant frequency of the LH mode resonance in the low band.

Figure 9A:
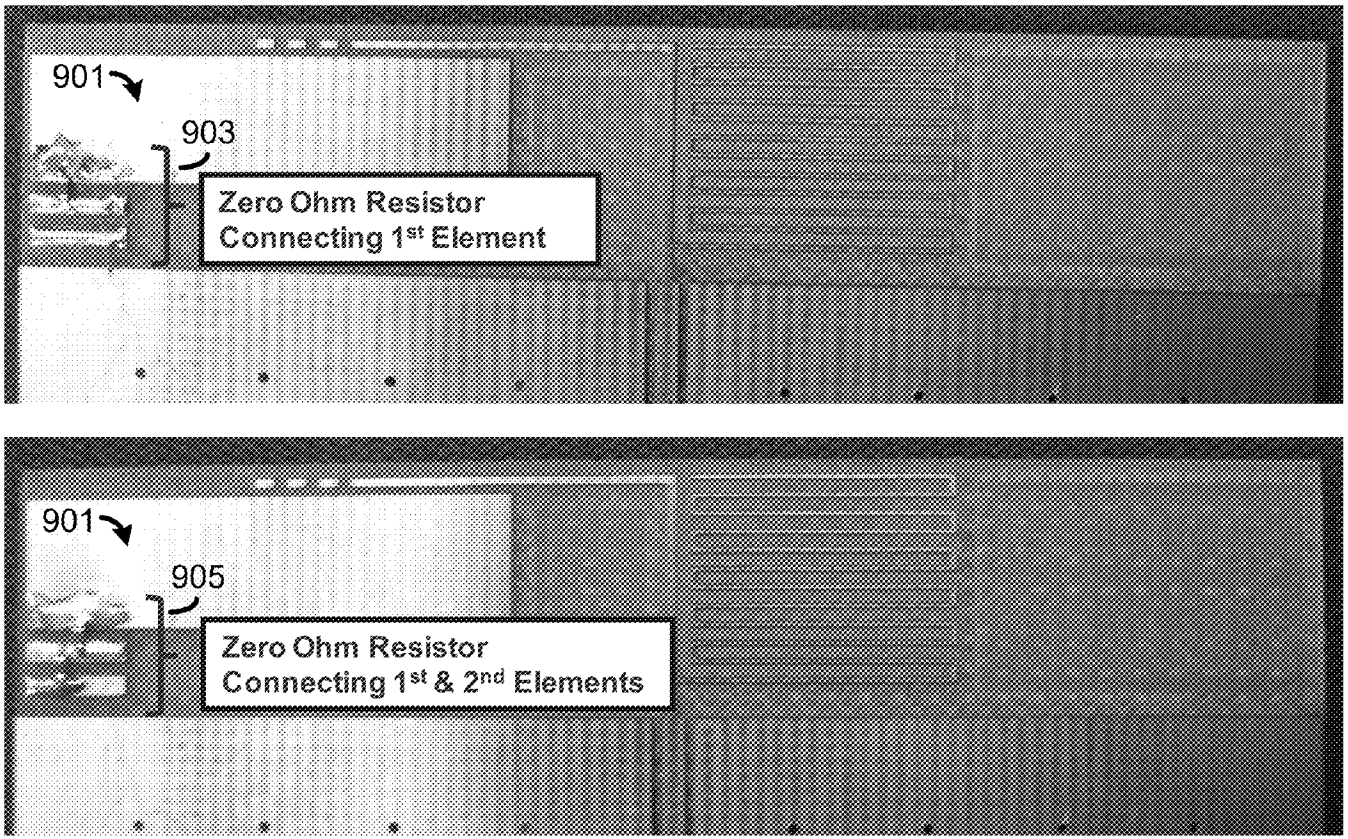
FIG. 9A illustrates a photograph of cell patch tuning elements connected in Antenna 2.

FIG. 9A shows one photograph (top) for the case of a first cell patch tuning element being connected to the cell patch 901 by a zero ohm resistor 903, and another photograph (bottom) for the case of the first cell patch tuning element being connected to the cell patch 901 by a zero ohm resistor and a second cell patch tuning element being connected to the first one by another zero ohm resistor 905.

Figure 9B:
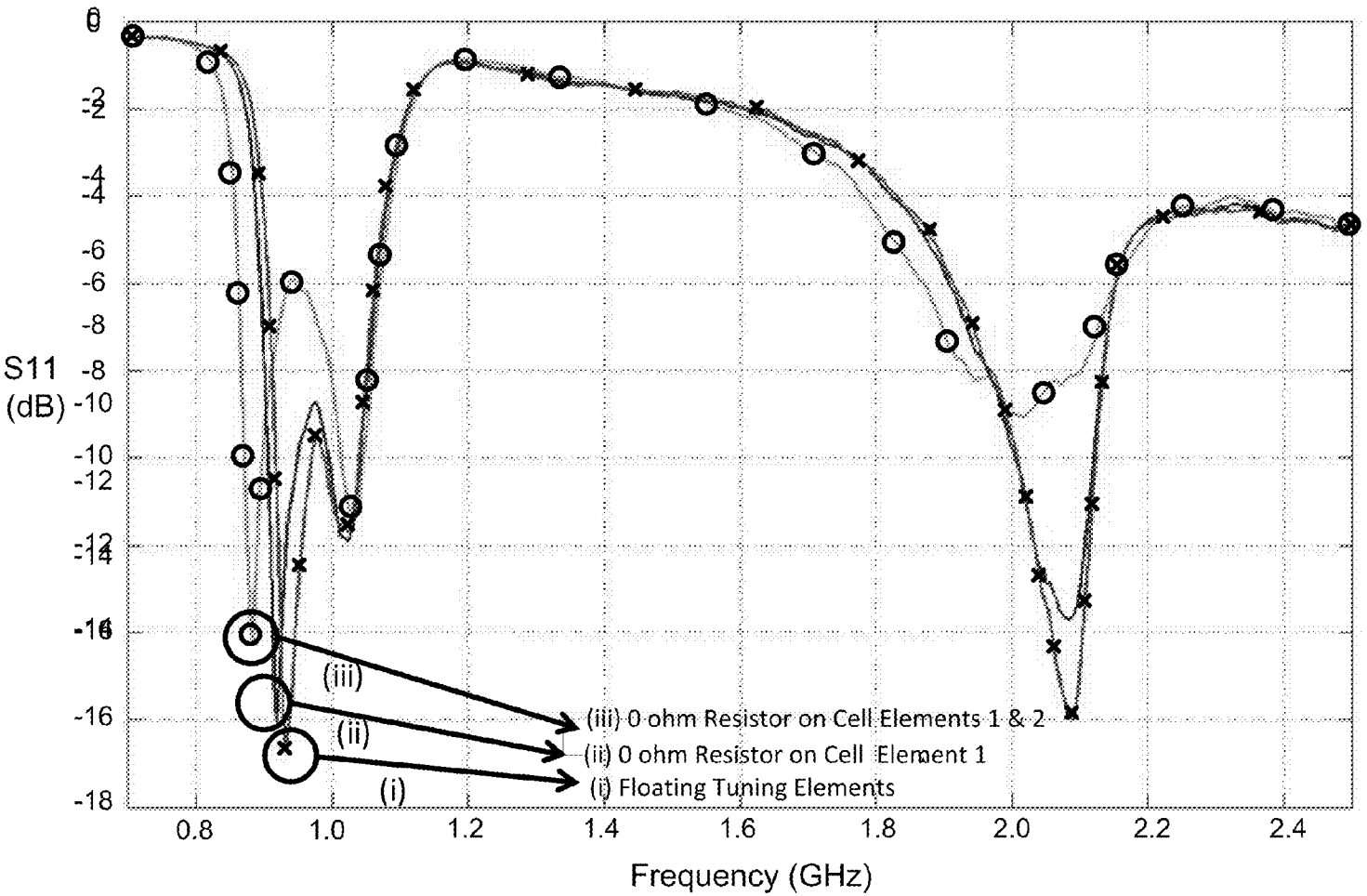
FIG. 9B illustrates a measured return loss of the cell patch tuning elements connected as shown in FIG. 9A.

FIG. 9B shows the measured return loss results for the cases of: (i) all cell patch tuning elements being floated (Antenna 2); (ii) the first tuning element being connected to the cell patch by a zero ohm resistor; and (iii) the first tuning element being connected to the cell patch by a zero ohm resistor and the second tuning element being connected to the first one by another zero ohm resistor. As the number of connected cell patch tuning elements increases, the LH mode resonant frequency in the low band decreases, as shown in FIG. 9B. As the number of connected cell patch tuning elements increases, the RH monopole mode resonant frequency in the high band also decreases, but by a smaller scale. This decrease in resonant frequency may be attributed to an increase in the total electrical length of the cell patch.

Figure 9C:
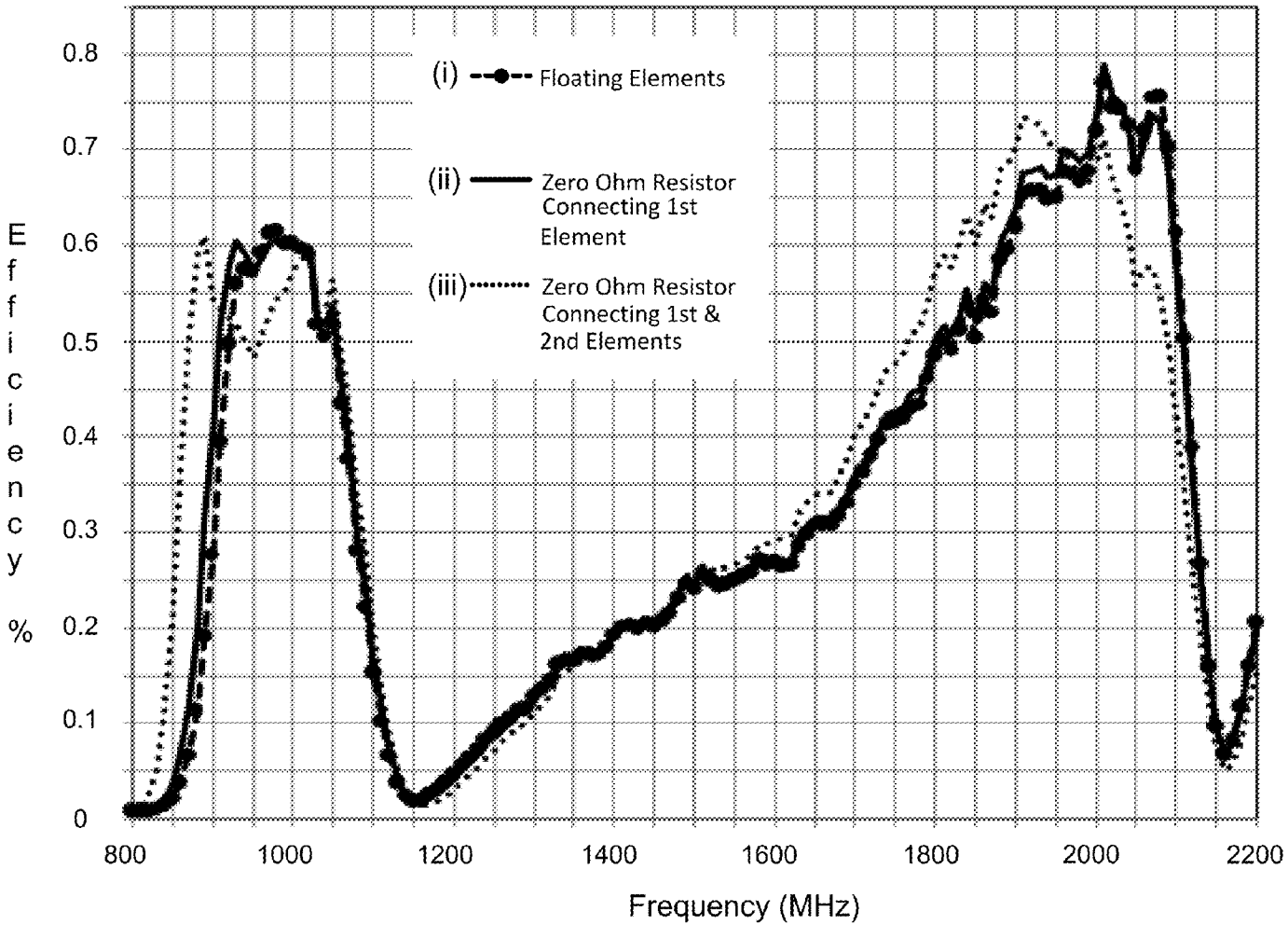
FIG. 9C illustrates a measured efficiency of the cell patch tuning elements connected as shown in FIG. 9A.

FIG. 9C shows the measured efficiency results for the above three cases (i), (ii) and (iii), indicated by the dashed line with solid circles, solid line and dotted line, respectively. As can be seen from FIG. 9C, the peak efficiency points shift corresponding to the resonant frequencies as the number of connected cell patch tuning elements changes.

Meandered Stub Tuning Elements

Meander stub tuning elements can be located close to the first turn of the meander stub of Antenna 2. When connected by connecting elements such as zero ohm resistors acting as bridges, meander stub tuning elements can be used to effectively change the length of the meander line. As mentioned earlier, the second resonance in the low band is an RH resonance and is controlled by the length of the meandered stub stemming from the feed line. Therefore, the meander stub tuning elements provide means for tuning the resonant frequency of the RH meander mode resonance in the low band.

Figure 10A:
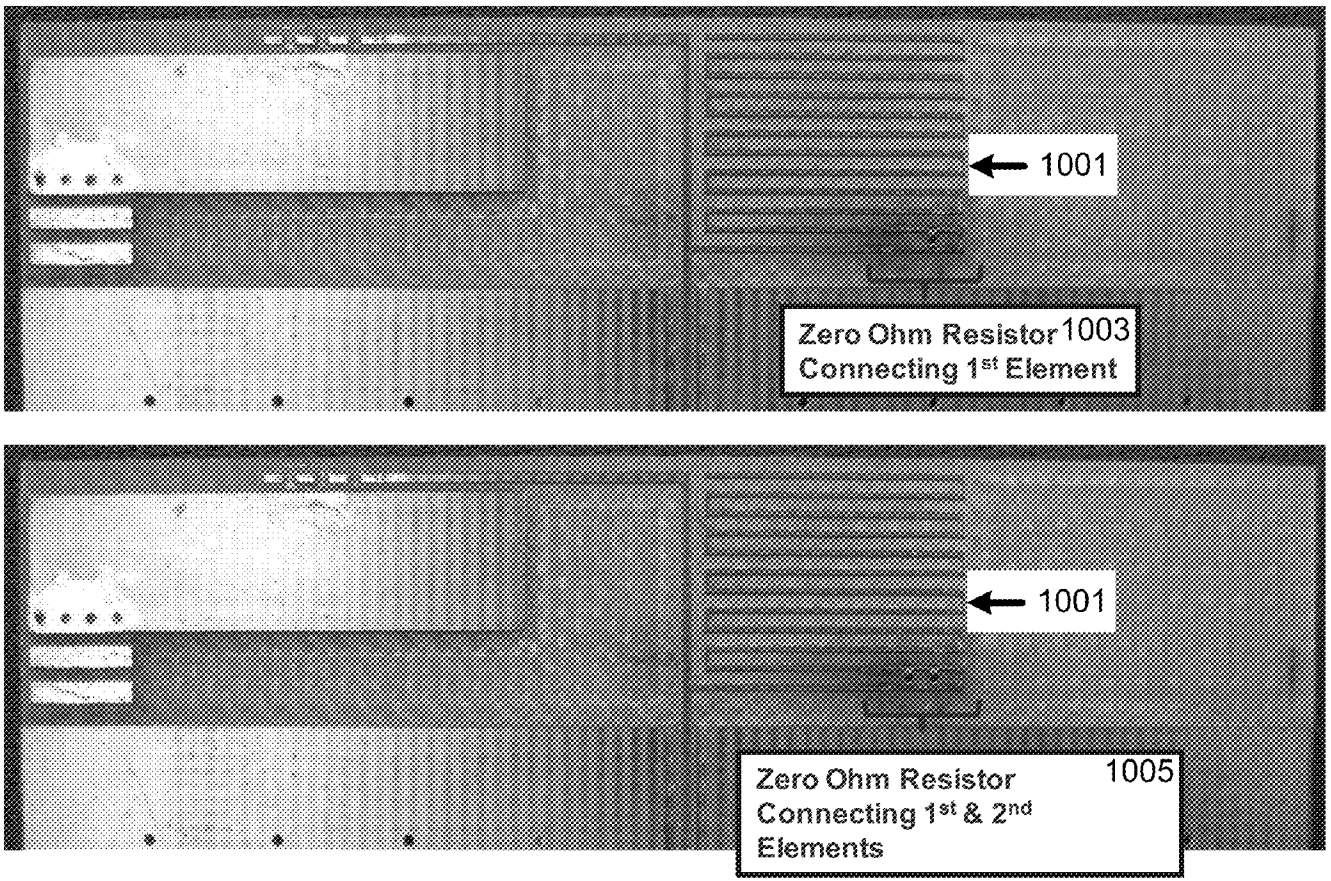
FIG. 10A illustrates a photograph of meandered stub tuning elements connected in Antenna 2.

FIG. 10A shows one photograph (top) for the case of a first pair of meander stub tuning elements 1003, located close to the first turn of a meander stub 1001, being connected by a zero ohm resistor, and another photograph (bottom) for the case of a first and a second pair of meander stub tuning elements 1005, each being connected by a zero ohm resistor. When both the first and second pairs are connected, the electrical current takes the shorter path through the second pair. Thus, increasing the number of connected pairs is essentially equivalent to shortening the length of the meander stub. The same effect can be obtained by simply detaching the zero ohm resistor from the first pair and attaching only the zero ohm resistor associated with the second pair.

Figure 10B:
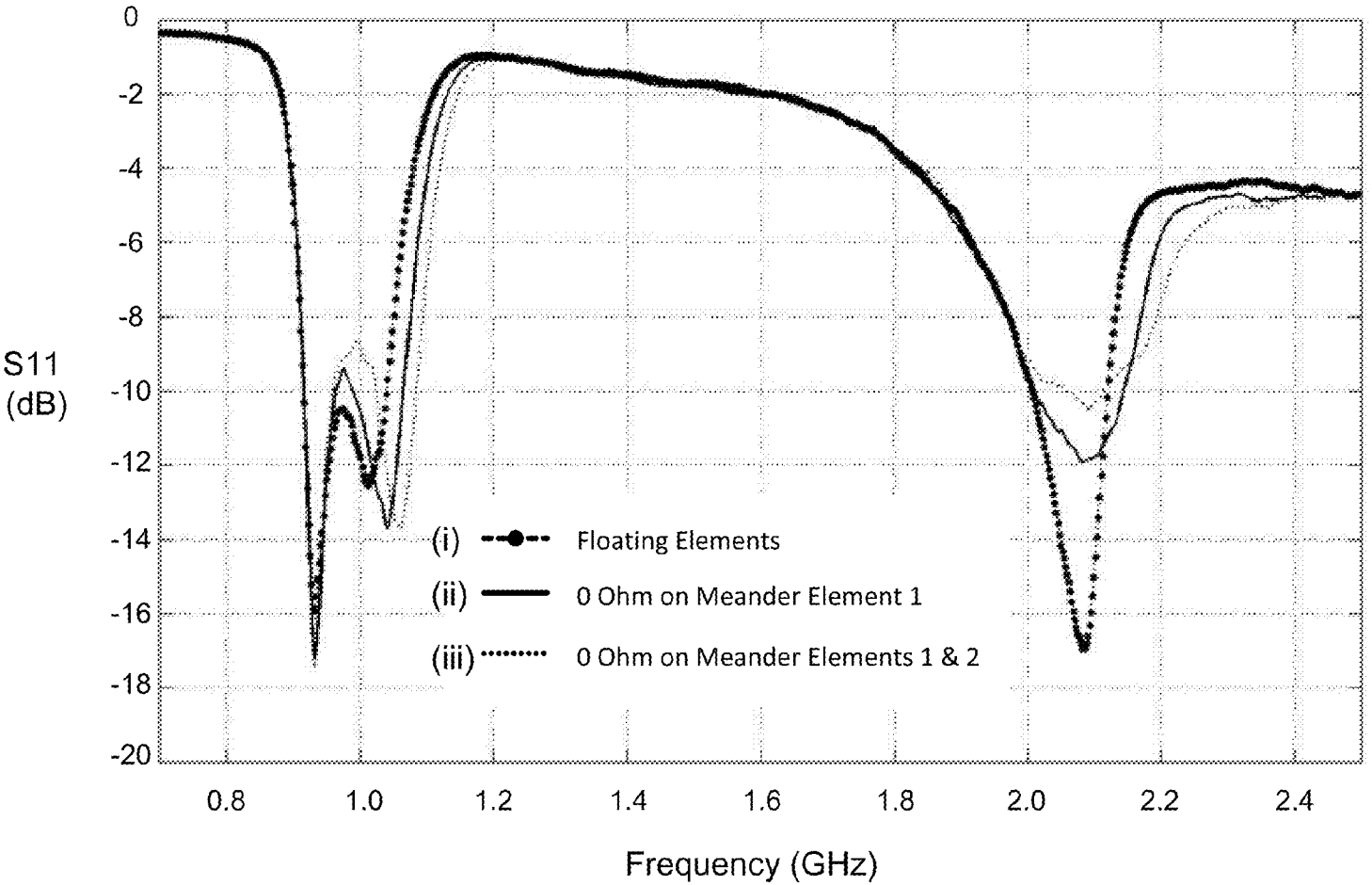
FIG. 10B illustrates a measured return loss an antenna of the meandered stub tuning elements connected as shown in FIG. 10A.

FIG. 10B shows the measured return loss results for the cases of: (i) all meandered stub tuning elements being floated (Antenna 2); (ii) the first pair of the tuning element being connected by a zero ohm resistor; and (iii) the first pair being connected by a zero ohm resistor and the second pair also being connected by another zero ohm resistor (or equivalently, only the second pair being connected by a zero ohm resister), indicated by the dotted line with solid circles, solid line and dotted line, respectively. As the number of connected pairs of the meandered stub tuning elements increases, the length of the meandered stub decreases, thereby increasing the RH meander mode resonant frequency in the low band as evidenced by FIG. 10B. The change in the return loss of the high band may be attributed to the shifting of the harmonic of the RH mode resonance which normally appears between 2.1 GHz and 2.2 GHz, depending on the geometry of the meandered stub.

Figure 10C:
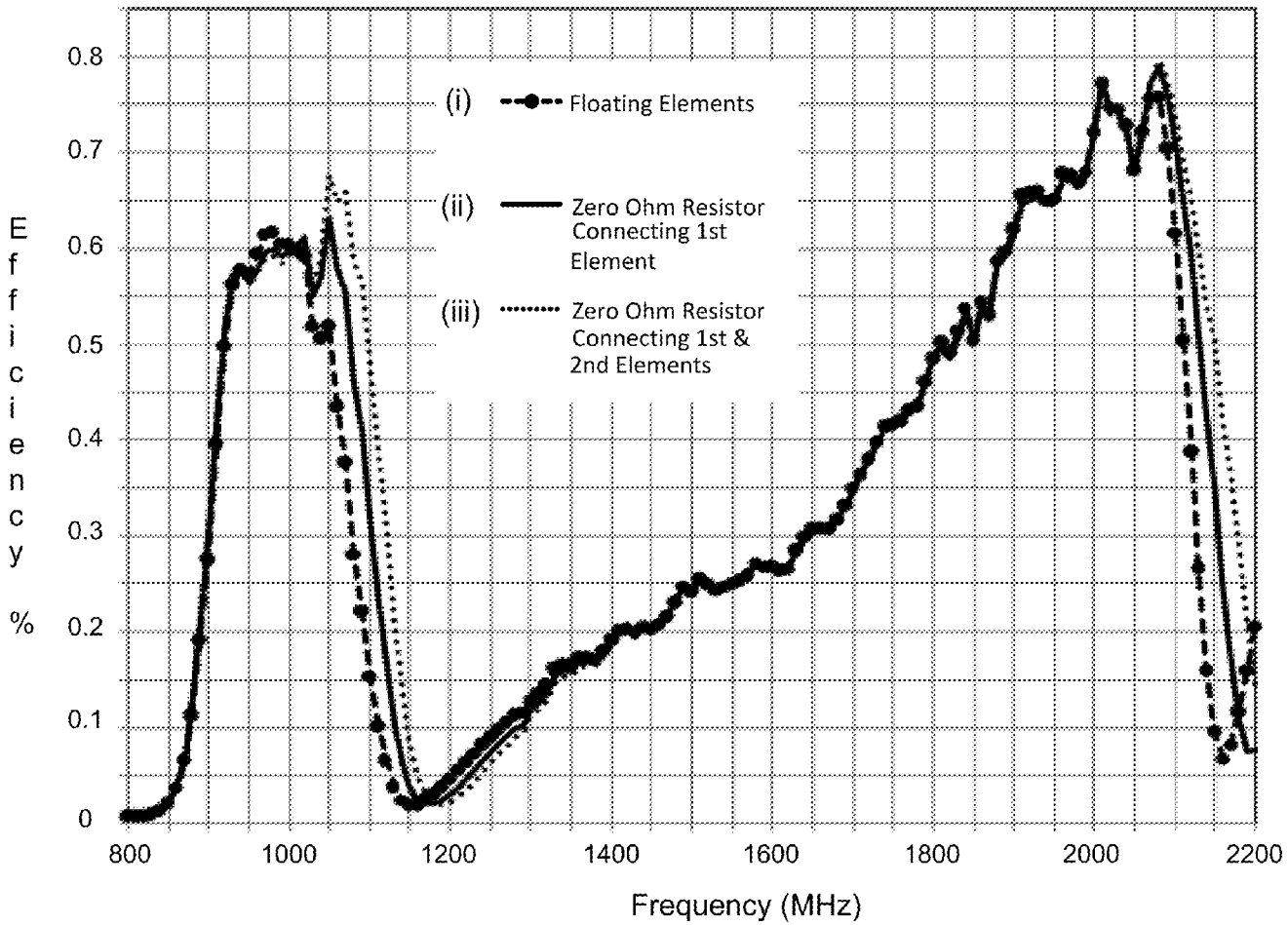
FIG. 10C illustrates a measured efficiency of the meandered stub tuning elements connected as shown in FIG. 10A.

FIG. 10C shows the measured efficiency results for the above three cases (i), (ii) and (iii), indicated by the dashed line with solid circles, solid line and dotted line, respectively. As can be seen from FIG. 10C, the peak efficiency points shift corresponding to the resonant frequencies as the number of connected pairs of the meandered stub tuning elements changes.

Via Line Tuning Elements

Via line tuning elements can be located close to the proximal end of the via line of Antenna 2. When connected by connecting elements such as zero ohm resistors acting as bridges, via line tuning elements can be used to effectively change the length of the via line. As mentioned earlier, one of the factors determining the LH resonance in the low band is the length of the via line stemming from the bottom ground. Therefore, the via line tuning elements provide means for tuning the resonant frequency of the LH mode resonance in the low band.

Figure 11A:
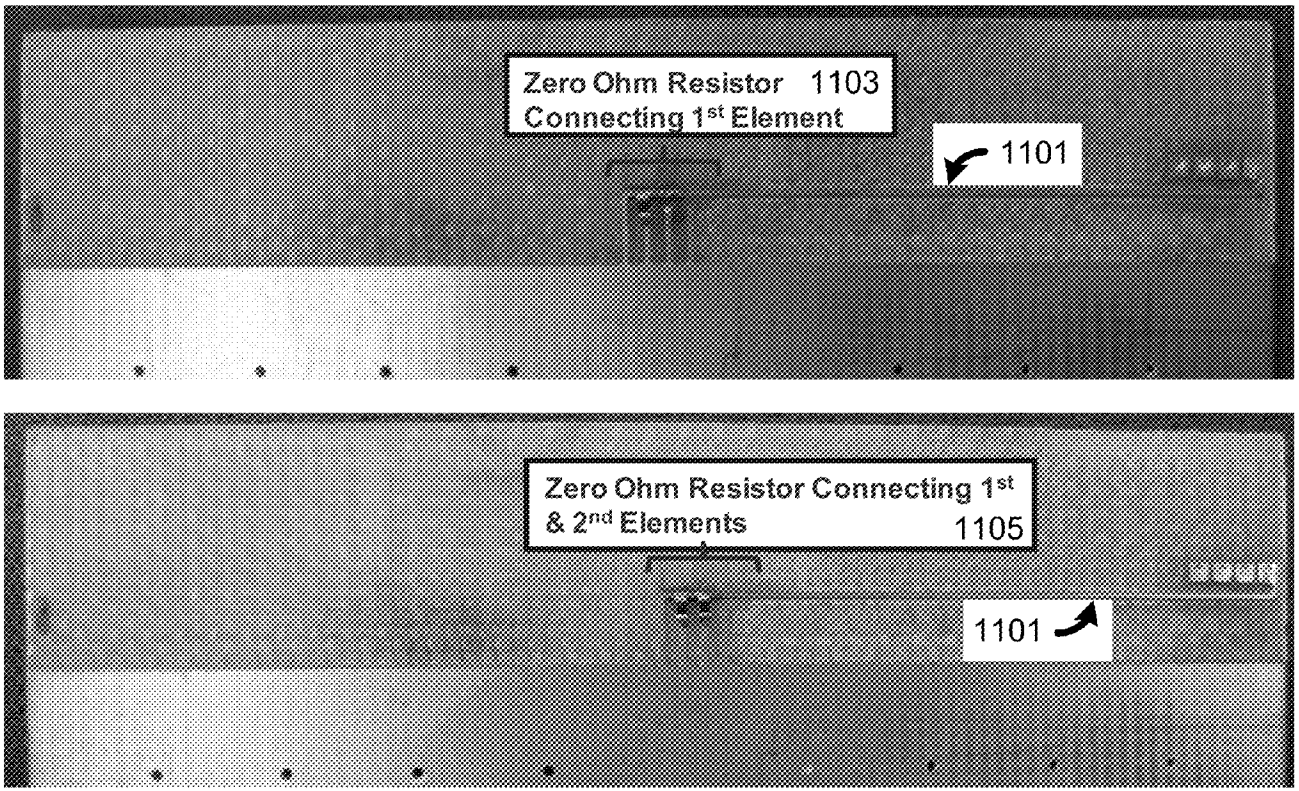
FIG. 11A illustrates a photograph of Via Line Tuning Elements Connected in Antenna 2.

FIG. 11A shows one photograph (top) for the case of a first via line tuning element being connected to a via line 1101 by a zero ohm resistor 1103, and another photograph (bottom) for the case of the first via line tuning element being connected to the via line 1101 by a zero ohm resistor and a second tuning element also being connected to the via line by another zero ohm resistor 1105. When both the first and second via line tuning elements are connected to the via line, the electrical current takes the shorter path through the second tuning element. Thus, increasing the number of connected tuning elements is essentially equivalent to shortening the length of the via line. The same effect can be obtained by simply detaching the zero ohm resistor from the first tuning element and attaching it to the second tuning element.

Figure 11B:
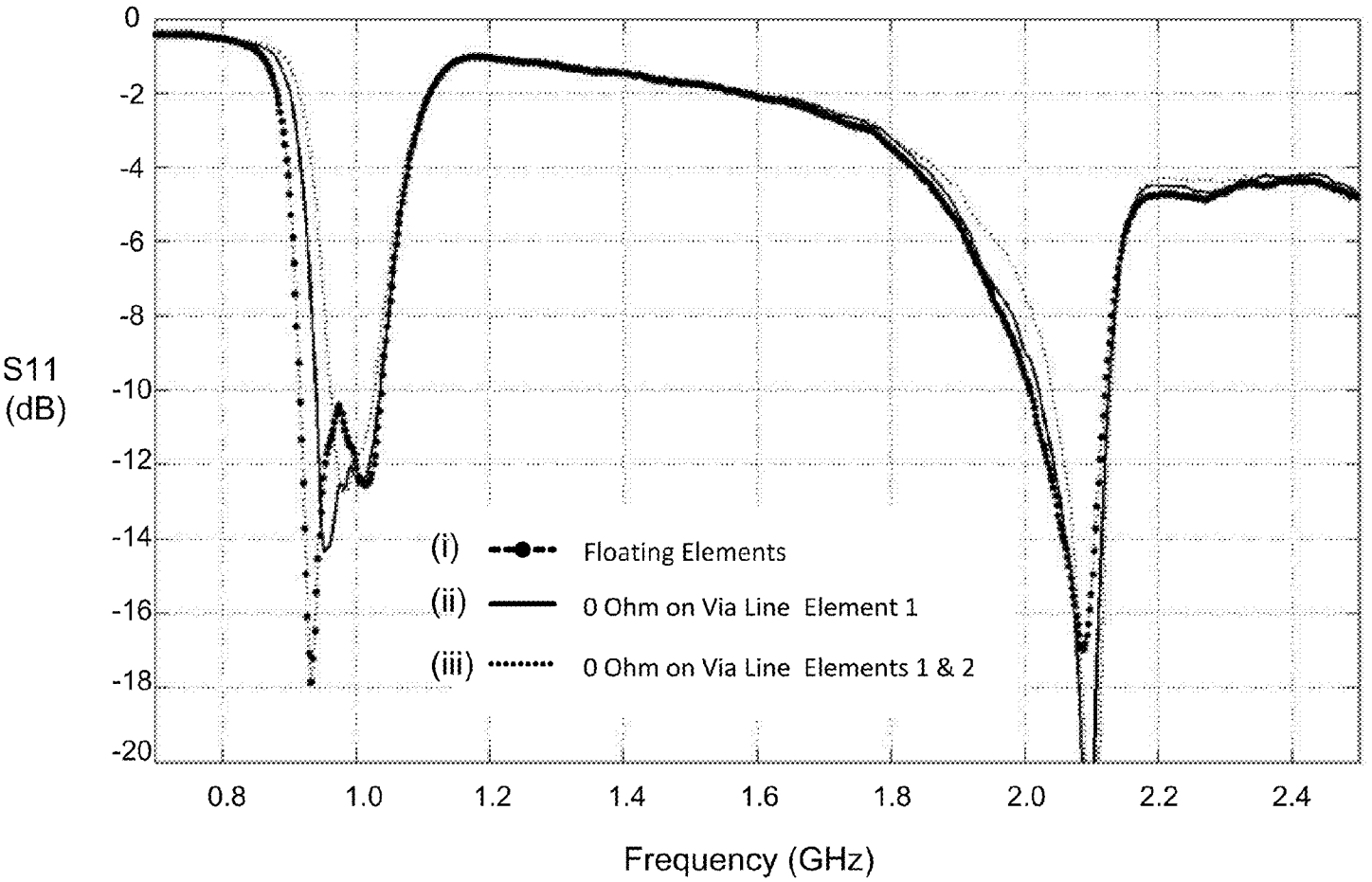
FIG. 11B illustrates a measured return loss of the via line tuning elements connected as shown in FIG. 11A.

FIG. 11B shows the measured return loss results for the cases of: (i) all via line tuning elements being floated (Antenna 2); (ii) the first tuning element being connected to the via line by a zero ohm resistor; and (iii) the first tuning element being connected to the via line by a zero ohm resistor and the second tuning element also being connected to the via line by another zero ohm resistor (or equivalently, only the second tuning element being connected to the via line by a zero ohm resister), indicated by the dotted line with solid circles, solid line and dotted line, respectively. As the number of connected via line tuning elements increases, the length of the via line decreases, thereby increasing the LH mode resonant frequency in the low band as shown in FIG. 11B. As the number of connected via line tuning elements increases, the RH monopole mode resonant frequency in the high band also increases, but by a smaller scale. This increase in resonant frequency may be attributed to a decrease in the total electrical length of the via line.

Figure 11C:
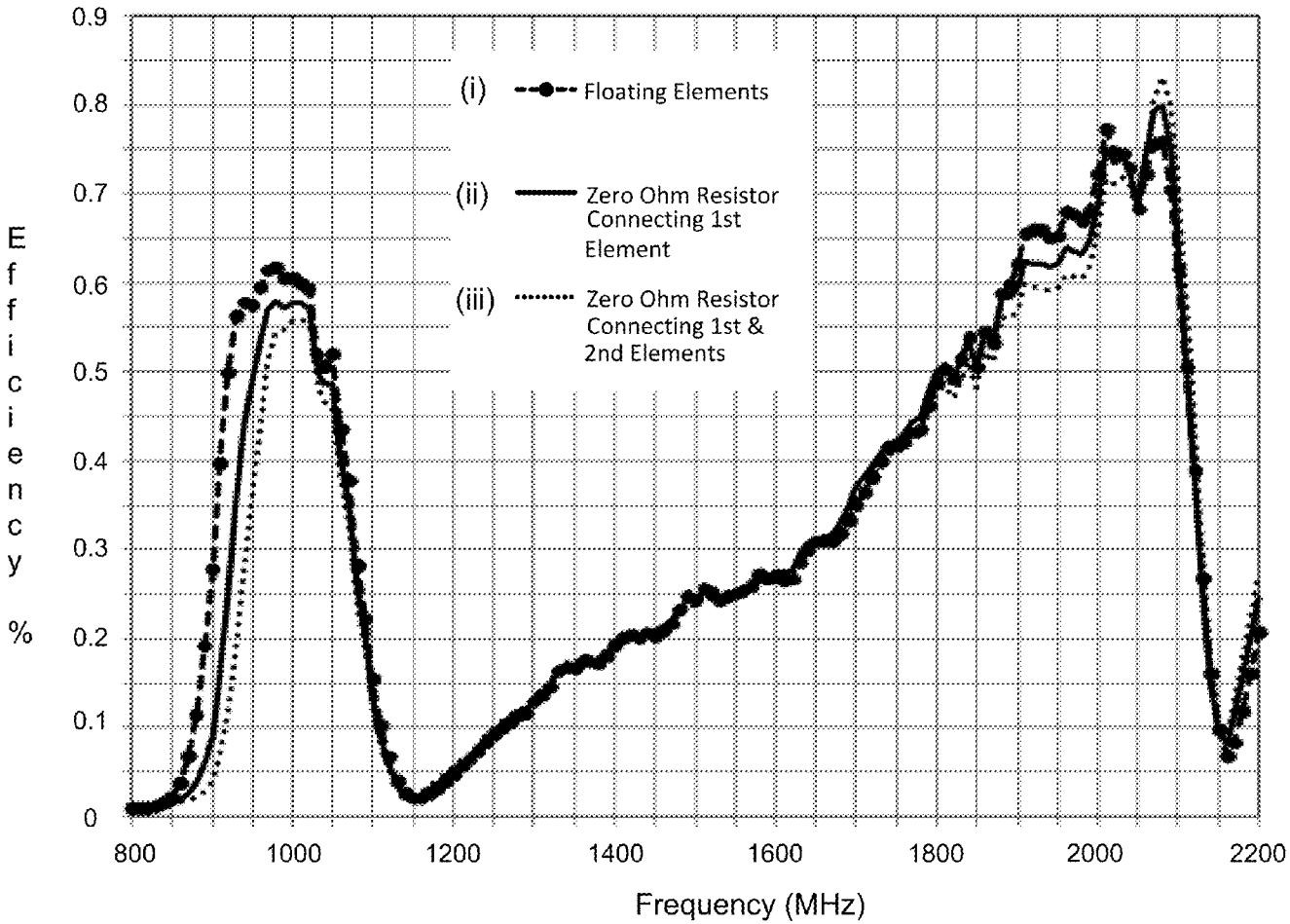
FIG. 11C illustrates a measured efficiency of the via line tuning elements connected as shown in FIG. 11A.

FIG. 11C shows the measured efficiency results for the above three cases (i), (ii) and (iii), indicated by the dashed line with solid circles, solid line and dotted line, respectively. As can be seen from FIG. 11C, the peak efficiency points shift corresponding to the resonant frequencies as the number of connected via line tuning elements changes. The slight decrease in efficiency seen in FIG. 11C is due to the decrease in bandwidth by the proximity of the LH and meander resonances.

Via Pad Tuning Elements

Similar to the via line tuning elements, via pad tuning elements can be used to change the overall length of the via line, and hence to tune the LH mode resonance in the low band.

Figure 12A:
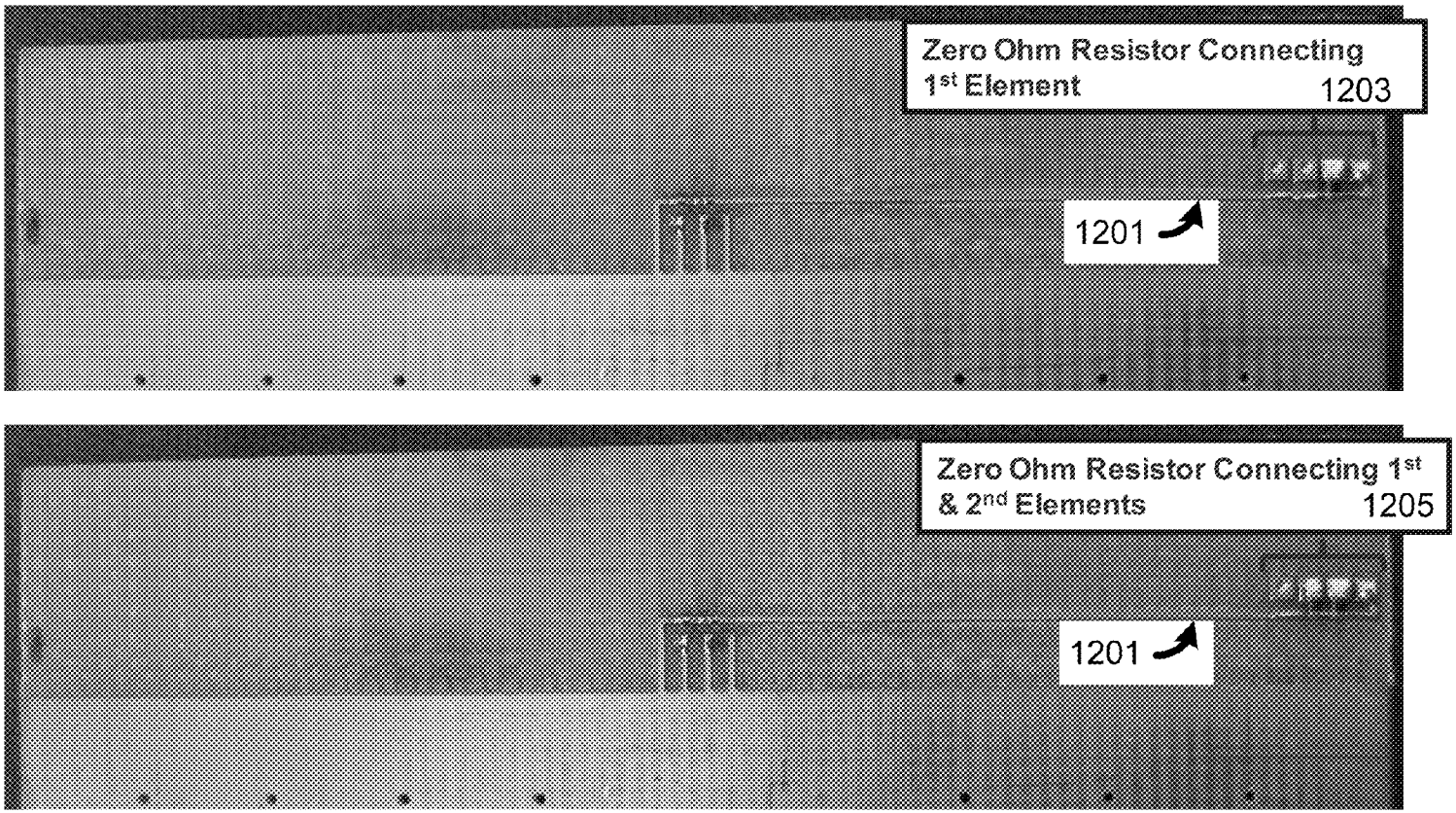
FIG. 12A illustrates a photograph of via pad tuning elements connected in Antenna 2.

FIG. 12A shows one photograph (top) for the case of a first via pad tuning element being connected to a via line 1201 by a zero ohm resistor 1203, and another photograph (bottom) for the case of the first via pad element being connected to the via line 1201 by a zero ohm resistor and a second tuning element also being connected to the via line by another zero ohm resistor 1205. When both the first and second via pad tuning elements are connected to the via line, the electrical current takes the shorter path through the second tuning element. Thus, increasing the number of connected tuning elements is essentially equivalent to shortening the length of the via line. The same effect can be obtained by simply detaching the zero ohm resistor from the first tuning element and attaching it to the second tuning element.

Figure 12B:
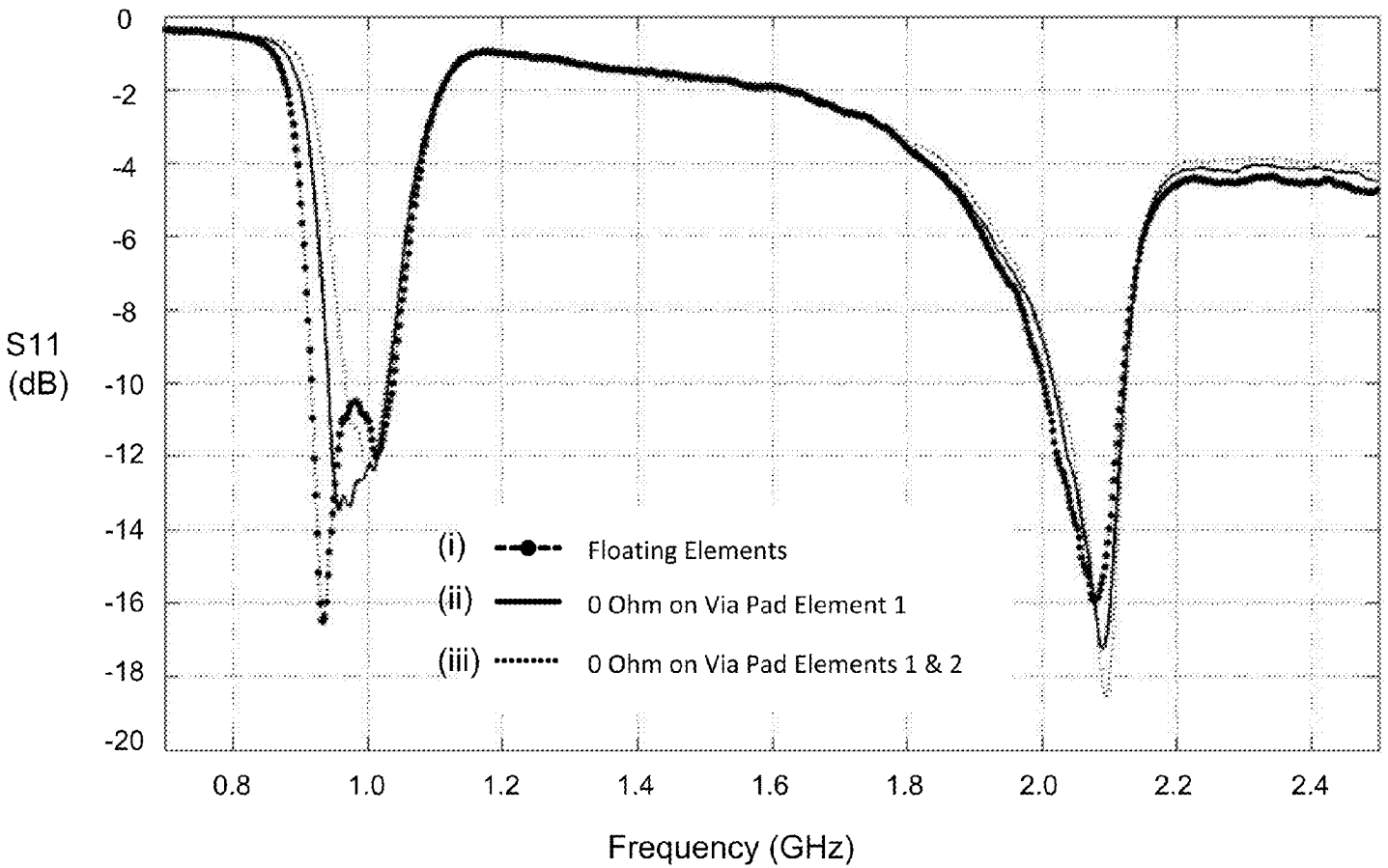
FIG. 12B illustrates a measured return loss of the via pad tuning elements connected as shown in FIG. 12A.

FIG. 12B shows the measured return loss results for the cases of: (i) all via pad tuning elements being floated (Antenna 2); (ii) the first tuning element being connected to the via line by a zero ohm resistor; and (iii) the first tuning element being connected to the via line by a zero ohm resistor and the second tuning element also being connected to the via line by another zero ohm resistor (or equivalently, only the second tuning element being connected to the via line by a zero ohm resister), indicated by the dotted line with solid circles, solid line and dotted line, respectively. As the number of connected via pad tuning elements increases, the length of the via line decreases, thereby increasing the LH mode resonant frequency in the low band as shown in FIG. 12B. As the number of connected via line tuning elements increases, the RH monopole mode resonant frequency in the high band also increases, but by a smaller scale. This increase in resonant frequency may be attributed to a decrease in the total electrical length of the via line.

Figure 12C:
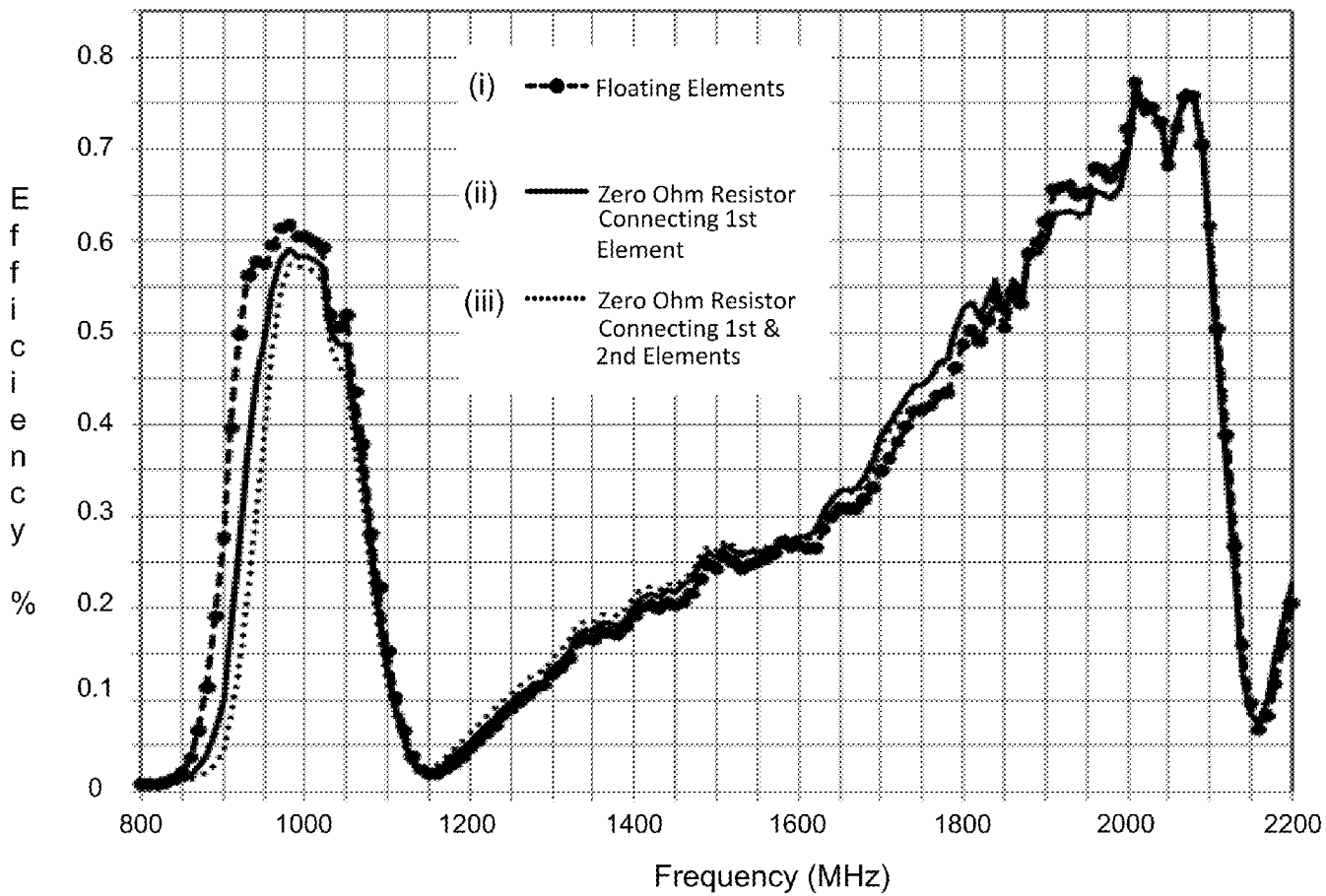
FIG. 12C illustrates a measured efficiency of the via pad tuning elements connected as shown in FIG. 12A.

FIG. 12C shows the measured efficiency results for the above three cases (i), (ii) and (iii), indicated by the dashed line with solid circles, solid line and dotted line, respectively. As can be seen from FIG. 12C, the peak efficiency points shift corresponding to the resonant frequencies as the number of connected via pad tuning elements changes. The slight decrease in efficiency seen on FIG. 12C may be attributed to the decrease in bandwidth by the proximity of the LH and meander resonances.

Figure 13A:
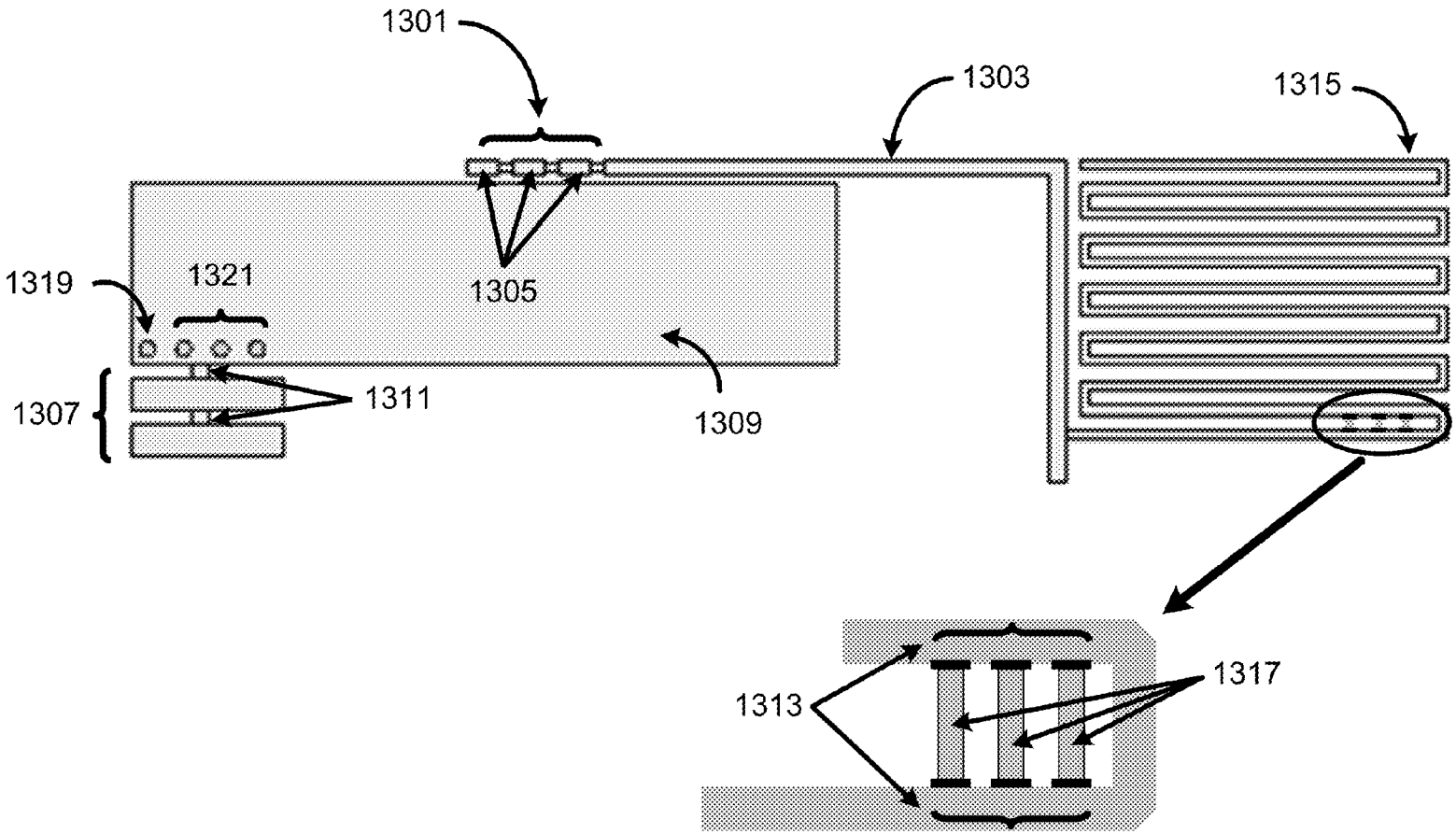
FIG. 13A illustrates a computer-generated top view of a top layer of an CRLH MTM antenna with tunable elements (Antenna 3)
Figure 13B:
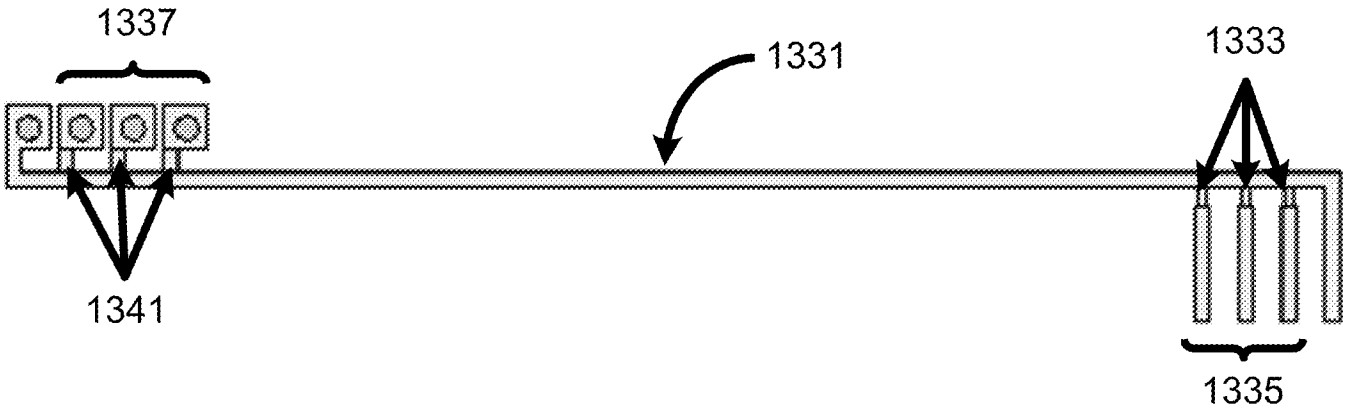
FIG. 13B illustrates a computer-generated top view of a bottom layer of the CRLH MTM antenna shown in FIG. 13A.

FIG. 13A-13B represents another example of a tunable antenna structure, referred to as Antenna 3, which is a modified configuration of Antenna 2. In Antenna 3, all individual conductive elements associated with each tuning element can be simultaneously connected to a corresponding structure. Thus, tuning can be accomplished by disconnecting selected individual conductive elements as shown in FIG. 13A-13B. For example, in FIG. 13A, feed line tuning elements 1301 located close to the distal end of a feed line 1303 of Antenna 3 are simultaneously connected to the feed line 1303 by connecting elements 1305 such as zero ohm resistors or conductive strips acting as bridges. As previously mentioned, the RH resonance near 2 GHz in the high band is due to the monopole mode, which may be controlled by the length of the feed line 1303 and can be altered by disconnecting certain connecting elements 1305 that bridge the feed line tuning elements 1301. Therefore, the feed line tuning elements 1301 provide means for tuning the resonant frequency of the RH monopole mode resonance in the high band by selectively disconnecting certain connecting elements. Cell patch tuning elements 1307, which are located close to one end of a cell patch 1309 of Antenna 3, are simultaneously connected to the cell patch 1309 by connecting elements 1311 such as zero ohm resistors or conductive strips acting as bridges. This connection effectively changes the size, shape and dimensions of the cell patch 1309. As mentioned earlier, the LH resonance in the low band is controlled by the layout and shape of the cell patch 1309 which can be altered by disconnecting certain connecting elements 1311 that bridge the cell patch tuning elements 1307. Therefore, the cell patch tuning elements 1307 provide means for tuning the resonant frequency of the LH mode resonance in the low band. Meander stub tuning elements 1313 located close to the first turn of a meander stub 1315 of Antenna 3, are simultaneously connected by connecting elements 1317 such as zero ohm resistors or conductive strips acting as bridges. Such connection effectively changes the length of the meander line 1315. As mentioned earlier, the second resonance in the low band is an RH resonance and is controlled by the length of the meandered stub 1315 stemming from the feed line 1303. Therefore, the meander stub tuning elements 1313 provide means for tuning the resonant frequency of the RH meander mode resonance in the low band. Referring to FIG. 13B, via line tuning elements 1325 located close to a proximal end of a via line 1331 of Antenna 3, are simultaneously connected by connecting elements 1333 such as zero ohm resistors or conductive strips acting as bridges, effectively change the length of the via line 1331. As mentioned earlier, one of the factors determining the LH resonance in the low band is the length of the via line 1331 stemming from the bottom ground. Therefore, the via line tuning elements 1331 provide means for tuning the resonant frequency of the LH mode resonance in the low band. Via pad tuning elements 1337 located close to the other end of the via line 1331 of Antenna 3, are simultaneously connected by connecting elements 1341 such as zero ohm resistors or conductive strips acting as bridges, effectively change the length of the via line 1331. Via pad tuning elements 1337 can be used to change the overall length of the via line 1331, and hence to tune the LH mode resonance in the low band.

Disconnecting one or more selected connecting elements in Antenna 3 can be used as a quick and efficient means for tuning and allowing for a reproducible design at each disconnected point. Like the previous case, the return loss and efficiency for Antenna 3 are the same as in the case of Antenna 2.

Figure 14A:
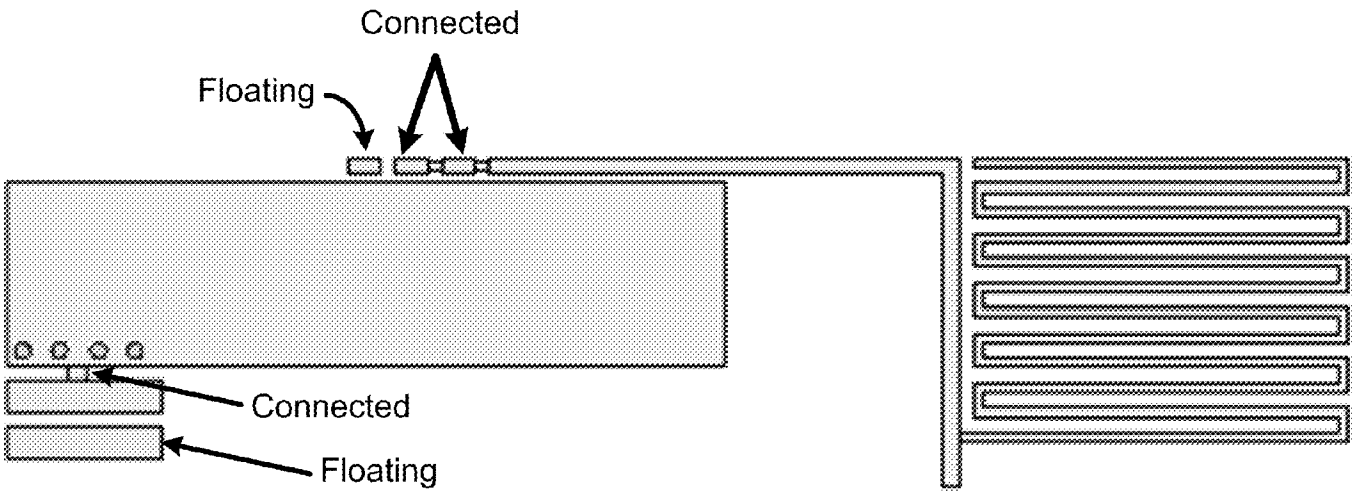
FIG. 14A illustrates a computer-generated top view of a top layer of Antenna 3 having connected and floating conductive connective elements.
Figure 14B:
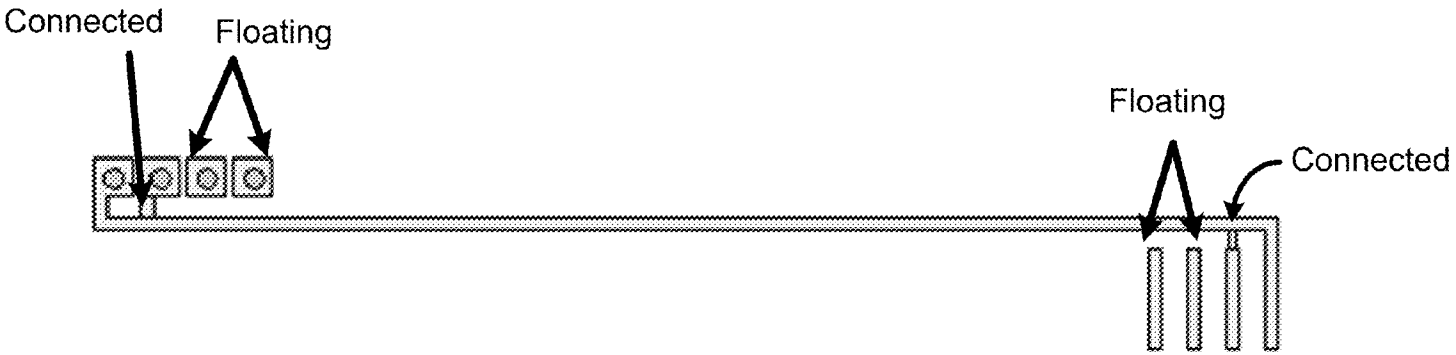
FIG. 14B illustrates a computer-generated top view of a bottom layer of Antenna 3 having connected and floating conductive connective elements.

In another configuration of Antenna 3, certain tunable elements can be connected while other tunable elements are floating, or disconnected from other elements, as shown in FIG. 14A-14B. As in the previous case, the return loss and efficiency in this configuration of Antenna 3 are the same as in the case of Antenna 2.

The tuning methods and structures described in this document may also be used in multi-cell designs, multilayer metamaterial designs, non-planar metamaterial structures, and other metamaterial related antenna designs.

Multi-cell designs, for example, are described in U.S. patent application Ser. No. 12/408,642 filed on Apr. 2, 2009 and entitled "Single-Feed Multi-Cell Metamaterial Antenna Devices". In a multi-cell design, two cells may be formed in a substrate with two opposing surfaces. A top layer of a Single-Feed Multi-Cell metamaterial antenna structure comprises a first cell conductive patch of a first cell formed on the first surface; a second cell conductive patch of a second cell formed on the first surface and adjacent to the first cell conductive patch by an insulation cell gap; and a shared conductive launch stub formed on the first surface adjacent to both the first and second cell conductive patches and separated from each of the first and second cell conductive patches by a capacitive coupling gap for the first cell and a capacitive coupling gap for the second cell, respectively, which are electromagnetically coupled to each of the first and second cell conductive patches. The shared conductive launch stub includes an extended strip line that directs and receives signals from the first and second cell conductive patches. A top ground conductive electrode is formed on the first surface and spaced away from the first and second cell conductive patches. In this example, the top ground conductive electrode is patterned to include a grounded co-planar waveguide (CPW) that has a first terminal and a second terminal in which the second terminal is connected to a feed line. The shared conductive launch stub has an extended strip line that is connected to the feed line to conduct signals to or from the two cell conductive patches.

The multi-cell design may be implemented in various configurations. For example, the launch stub can have different geometrical shapes such as, but not limited to, rectangular, spiral (circular, oval, rectangular, and other shapes), or meander shapes; the MTM cell patch can have different geometrical shapes such as, but not limited to, rectangular, spiral (circular, oval, rectangular, and other shapes), or meander shapes; the via pads can have different geometrical shapes and sizes such as, but not limited to, rectangular, circular, oval, polygonal, or irregular shapes; and the gap between the launch stub and the MTM cell patch can take different forms such as, but not limited to, a straight line shape, a curved shape, an L-shape, a meander shape, a zigzag shape, or a discontinued line shape. The via trace that connects the MTM cell to the GND may be located on the top or bottom layer in some implementations.

In a multi-cell design, tuning elements described in this document such as the feed line tuning elements, cell patch tuning elements, meandered stub tuning elements, via line tuning elements, and via pad tuning elements tuning elements may be formed near corresponding structural elements such as the feed line, cell patch, meander stub, via line and via pad, respectively. Each tuning element may utilize a conductive connector element that can be either connected or disconnected to other conductive connector elements to change the physical characteristics associated with each tuning element. Such changes in physical characteristics in turn affect resonant frequencies and efficiencies in the low and high bands.

In another implementation, tuning elements in this document can be used in two or more metallization layers in metamaterial antenna structures. Examples of suitable metamaterial structures having two or more metallization layers are metamaterial structures described herein and other metamaterial structures. For example, multilayer metallization metamaterial structures described in U.S. patent application Ser. No. 12/270,410 filed on Nov. 13, 2008 and entitled "Metamaterial Structures with Multilayer Metallization and Via" can be used to implement several tuning elements previously presented. The entire disclosure of the application Ser. No. 12/270,410 is incorporated by reference as part of the disclosure of this document.

application Ser. No. 12/270,410 discloses techniques and apparatus based on metamaterial structures for antenna and transmission line devices, including multilayer metallization metamaterial structures with one or more conductive vias connecting conductive parts in two different metallization layers. In one aspect, a metamaterial device is provided to include a substrate, a plurality of metallization layers associated with the substrate and patterned to have a plurality of conductive parts, and a conductive via formed in the substrate to connect a conductive part in one metallization layer to a conductive part in another metallization layer. The conductive parts and the conductive via form a composite right and left handed (CRLH) metamaterial structure. In one implementation of the device, the conductive parts and the conductive via of the CRLH MTM structure are structured to form a metamaterial antenna and are configured to generate two or more frequency resonances. In another implementation, two or more frequency resonances of the CRLH MTM structure are sufficiently close to produce a wide band. In another implementation, the parts and the conductive via of the CRLH MTM structure are configured to generate a first frequency resonance in a low band and a second frequency resonance in a high band, the first frequency resonance being a left-handed (LH) mode frequency resonance and the second frequency resonance being a right-handed (RH) mode frequency resonance. In yet another implementation, the parts and the conductive via of the CRLH MTM structure are configured to generate a first frequency resonance in a low band, a second frequency resonance in a high band, and a third frequency resonance which is substantially close in frequency to the first frequency resonance to be coupled with the first frequency resonance, providing a combined mode resonance band that is wider than the low band.

In another aspect disclosed in application Ser. No. 12/270,410, a metamaterial device is provided to include a substrate, a first metallization layer formed on a first surface of the substrate and patterned to comprise a cell patch and a launch pad that are separated from each other and are electromagnetically coupled to each other, and a second metallization layer formed on a second surface of the substrate parallel to the first surface and patterned to comprise a ground electrode located outside a footprint of the cell patch, a cell via pad located underneath the cell patch, a cell via line connecting the ground electrode to the cell via pad, an interconnect pad located underneath the launch pad, and a feed line connected to the interconnect pad. This device also includes a cell via formed in the substrate to connect the cell patch to the cell via pad and an interconnect via formed in the substrate to connect the launch pad to the interconnect pad. One of the cell patch and the launch pad is shaped to include an opening and the other of the cell patch and the launch pad is located inside the opening. The cell patch, the cell via, the cell via pad, the cell via line, the ground electrode, the launch pad, the interconnect via, the interconnect via and the feed line form a CRLH MTM structure. In another aspect, a wireless communication device includes a printed circuit board (PCB) comprising a portion that is structured to form an antenna. The antenna includes a CRLH MTM cell comprising a top metal patch on a first surface of the PCB, a bottom metal pad on a second, opposing surface of the PCB and a conductive via connecting the top metal patch and the bottom metal pad; and a grounded co-planar waveguide (CPW) formed on the top surface of the PCB at a location to be spaced from the CRLH metal material cell and comprising a planar waveguide (CPW) feed line, a top ground (GND) around the CPW feed line. The CPW feed line has a terminal located close to and capacitively coupled to the top metal patch of the CRLH MTM cell. The antenna also includes a bottom ground metal patch formed on the bottom surface of the PCB below the grounded CPW formed on the top surface of the PCB; and a bottom conductive path that connects the bottom ground metal path to the bottom metal pad of the CRLH MTM cell. In one implementation, the antenna is configured to have two or more resonances in different frequency bands, which may, for example, include a cellular band from 890 MHz to 960 MHz and a PCS band from 1700 MHz to 2100 MHz. In yet another aspect, a wireless communication device includes a printed circuit board (PCB) comprising a portion that is structured to form an antenna. This antenna includes a CRLH MTM cell comprising a top metal patch on a first surface of the PCB; a grounded co-planar waveguide (CPW) formed on the top surface of the PCB at a location to be spaced from the CRLH metal material cell and comprising a planar waveguide (CPW) feed line, a top ground (GND) around the CPW feed line, wherein the CPW feed line has a terminal located close to and capacitively coupled to the top metal patch of the CRLH MTM cell; and a top ground metal path formed on the top surface of the PCB to connect to the top ground and the top metal patch of the CRLH MTM cell. In one implementation, the antenna is configured to have two or more resonances in different frequency bands, which may, for example, include a cellular band from 890 MHz to 960 MHz and a PCS band from 1700 MHz to 2100 MHz.

In a multilayer design, tuning elements such as the feed line tuning elements, cell patch tuning elements, meandered stub tuning elements, via line tuning elements, and via pad tuning elements tuning elements may be formed near corresponding structural elements such as the feed line, cell patch, meander stub, via line and via pad, respectively. Each tuning element may utilize an electrically conductive connector element that can be either connected or disconnected to other conductive connector elements to change the physical characteristics associated with each tuning element. Such changes in physical characteristics in turn affect resonant frequencies and efficiencies in the low and high bands.

In addition, the tuning elements in this document can be implemented in non-planar metamaterial configurations. Such non-planar metamaterial antenna structures arrange one or more antenna sections of an metamaterial antenna away from one or more other antenna sections of the same metamaterial antenna so that the antenna sections of the metamaterial antenna are spatially distributed in a non-planar configuration to provide a compact structure adapted to fit to an allocated space or volume of a wireless communication device, such as a portable wireless communication device. For example, one or more antenna sections of the metamaterial antenna can be located on a dielectric substrate while placing one or more other antenna sections of the metamaterial antenna on another dielectric substrate so that the antenna sections of the metamaterial antenna are spatially distributed in a non-planar configuration such as an L-shaped antenna configuration. In various applications, antenna portions of a metamaterial antenna can be arranged to accommodate various parts in parallel or non-parallel layers in a three-dimensional (3D) substrate structure. Such non-planar metamaterial antenna structures may be wrapped inside or around a product enclosure. The antenna sections in a non-planar metamaterial antenna structure can be arranged to engage to an enclosure, housing walls, an antenna carrier, or other packaging structures to save space. In some implementations, at least one antenna section of the non-planar metamaterial antenna structure is placed substantially parallel with and in proximity to a nearby surface of such a packaging structure, where the antenna section can be inside or outside of the packaging structure. In some other implementations, the metamaterial antenna structure can be made conformal to the internal wall of a housing of a product, the outer surface of an antenna carrier or the contour of a device package. Such non-planar metamaterial antenna structures can have a smaller footprint than that of a similar metamaterial antenna in a planar configuration and thus can be fit into a limited space available in a portable communication device such as a cellular phone. In some non-planar metamaterial antenna designs, a swivel mechanism or a sliding mechanism can be incorporated so that a portion or the whole of the metamaterial antenna can be folded or slid in to save space while unused. Additionally, stacked substrates may be used with or without a dielectric spacer to support different antenna sections of the metamaterial antenna and incorporate a mechanical and electrical contact between the stacked substrates to utilize the space above the main board.

Non-planar, 3D metamaterial antennas can be implemented in various configurations. For example, the metamaterial cell segments described herein may be arranged in non-planar, 3D configurations for implementing a design having tuning elements formed near various metamaterial structures. U.S. patent application Ser. No. 12/465,571 filed on May 13, 2009 and entitled "Non-Planar Metamaterial Antenna Structures", for example, discloses 3D antennas structure that can implement tuning elements near metamaterial structures. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a composite right and left handed (CRLH) metamaterial (MTM) antenna supporting at least one resonance frequency in an antenna signal and having a dimension less than one half of one wavelength of the resonance frequency. In another aspect, the application Ser. No. 12/465,571 discloses an antenna device structured to engage an packaging structure. This antenna device includes a first antenna section configured to be in proximity to a first planar section of the packaging structure and the first antenna section includes a first planar substrate, and at least one first conductive part associated with the first planar substrate. A second antenna section is provided in this device and is configured to be in proximity to a second planar section of the packaging structure. The second antenna section includes a second planar substrate, and at least one second conductive part associated with the second planar substrate. This device also includes a joint antenna section connecting the first and second antenna sections. The at least one first conductive part, the at least one second conductive part and the joint antenna section collectively form a composite right and left handed (CRLH) metamaterial structure to support at least one frequency resonance in an antenna signal. In yet another aspect, the application Ser. No. 12/465,571 discloses an antenna device structured to engage to an packaging structure and including a substrate having a flexible dielectric material and two or more conductive parts associated with the substrate to form a composite right and left handed (CRLH) metamaterial structure configured to support at least one frequency resonance in an antenna signal. The CRLH MTM structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

Non-planar, 3D metamaterial antennas can be configured to use tuning elements such as the feed line tuning elements, cell patch tuning elements, meandered stub tuning elements, via line tuning elements, and via pad tuning elements tuning elements which are connected to corresponding structural elements such as the feed line, cell patch, meander stub, via line and via pad, respectively. Each tuning element may utilize a conductive connector element that can be either connected or disconnected to other conductive connector elements to change the physical characteristics associated with each tuning element. Such changes in physical characteristics in turn affect resonant frequencies and efficiencies in the low and high bands. Furthermore, the above structures can be used to design other RF components such as but not limited to filters, power combiner and splitters, diplexers, and the like. Also, the above structures can be used to design RF front-end subsystems.

Combination of these configurations can be used to improve impedance matching and achieve high efficiency in all bands of interest.

As mentioned earlier, the tuning elements can be varied in terms of the number, location, size, shape, spacing and various other geometrical parameters depending on which resonances to tune by how much. The present tuning technique by use of the tuning elements provides practical ways to fine tune the resonant frequencies after the antenna is printed on the circuit board, thus simplifying the design, prototyping, fabrication, repair, and various other processes prior to mass production with the final design.

In the above examples the base metamaterial antenna has two layers with a via connecting two conductive parts in the different layers, a single layer via-less metamaterial antenna structure or a multilayer metamaterial antenna structure (with more than two layers) can also be implemented with the tuning elements. In the single layer via-less structure, the via pad tuning elements are not necessary.

While this document contains many specifics, these should not be construed as limitations on the scope of any invention or of what is claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features is described above as acting in certain combination can in some cases be exercised for the combination, and the claimed combination is directed to a subcombination or variation of a subcombination.

Particular implementations have been described in this document. Variations and enhancements of the described implementations and other implementations can be made based on what is described and illustrated in this document.

What is claimed is:

1. A metamaterial antenna device comprising:

a substrate;

a plurality of electrically conductive parts formed on the substrate, including:

a ground electrode;

a cell patch;

a via line connecting the cell patch and the ground electrode;

a feed line, a distal end of which is electromagnetically coupled to the cell patch through a gap to direct a signal to or from the cell patch; and a meander stub, one end of which is connected to the feed line; and a plurality of tuning elements formed on the substrate, wherein the electrically conductive parts are configured to form a composite right and left handed (CRLH) metamaterial antenna structure that generates a first plurality of frequency resonances when none of the tuning elements is connected to any of the electrically conductive parts, wherein the first plurality of frequency resonances include a first left handed (LH) mode resonance and a first low right handed (RH) mode resonance in a low band and a first high RH mode resonance in a high band, and wherein one or more of the tuning elements, when electrically connected to the conductive parts, reconfigure the CRLH MTM antenna structure to generate a second plurality of frequency resonances different from the first plurality of frequency resonances.

2. The metamaterial antenna device as in claim 1, wherein the cell patch and the via line are formed on different surfaces of the substrate, and wherein the via line includes:

a via pad; and a via formed in the substrate and connecting the cell patch and the via pad.

3. The metamaterial antenna device as in claim 1, wherein the tuning elements include a plurality of feed line tuning elements formed close to the feed line, the feed line tuning elements being spatially separated from one another, wherein one or more of the feed line tuning elements, when electrically connected to or disconnected from the feed line, change a dimension and a shape of the feed line to reconfigure the CRLH MTM antenna structure to generate a second high RH mode resonance that has a different frequency from the first high RH mode resonance.

4. The metamaterial antenna device as in claim 1, wherein the tuning elements include a plurality of cell patch tuning elements formed close to the cell patch, the cell patch tuning elements being spatially separated from one another, wherein one or more of the cell patch tuning elements, when electrically connected to or disconnected from the cell patch, change a dimension and a shape of the cell patch to reconfigure the CRLH MTM antenna structure to generate a second LH mode resonance that has a different frequency from the first LH mode resonance.

5. The metamaterial antenna device as in claim 1, wherein the tuning elements include a plurality of meander stub tuning elements attached to the meander stub, wherein two or more of the meander stub tuning elements, when electrically connected to or disconnected from one another, change a dimension and a shape of the meander stub to reconfigure the CRLH MTM antenna structure to generate a second low RH mode resonance that has a different frequency from the first low RH mode resonance.

6. The metamaterial antenna device as in claim 1, wherein the tuning elements include a plurality of via line tuning elements formed close to the via line, the via line tuning elements being spatially separated from one another, wherein one or more of the via line tuning elements, when electrically connected to the via line, become part of the via line and thus change a dimension and a shape of the via line to reconfigure the CRLH MTM antenna structure to generate a second LH mode resonance that has a different frequency from the first LH mode resonance.

7. The metamaterial antenna device as in claim 2, wherein the tuning elements include a plurality of via pad tuning elements formed close to the via pad, the via pad tuning elements being spatially separated from one another, and wherein one or more of the via pad tuning elements, when electrically connected to the via pad, become part of the via pad and thus change a dimension and a shape of the via pad to reconfigure the CRLH MTM antenna structure to generate a second LH mode resonance that has a different frequency from the first LH mode resonance.

8. The metamaterial antenna device as in claim 1, wherein the cell patch is located on a first metallization layer of the substrate, and wherein the ground electrode is located on a different second metallization layer of the substrate, the ground electrode located outside a footprint of the cell patch projected from the first metallization layer of the substrate to the second metallization layer of the substrate.

9. The metamaterial antenna device as in claim 1, comprising a zero-ohm resistor to electrically connect a selected tuning element to the CRLH MTM antenna structure.

10. A method of tuning a metamaterial antenna device, comprising:

providing a substrate for the metamaterial antenna device;

forming a plurality of conductive parts on the substrate to form a composite right and left handed (CRLH) metamaterial antenna structure that generates a first plurality of frequency resonances, the forming the plurality of conductive parts including:

forming a ground electrode, a feed line and a cell patch;

forming a via line to connect the cell patch and the ground electrode;

electromagnetically coupling a distal end of the feed line to the cell patch through a gap to direct a signal to or from the cell patch; and forming a meander stub with one end attached to the feed line; and forming a plurality of tuning elements on the substrate; and connecting one or more of the tuning elements to the conductive parts to reconfigure the CRLH MTM antenna structure in a way that generates a second plurality of frequency resonances, wherein the CRLH MTM antenna structure generates a first left handed (LH) mode resonance and a first low right handed (RH) mode resonance in a low band and a first high RH mode resonance in a high band.

11. The method as in claim 10, wherein the forming of the plurality of tuning elements on the substrate includes forming feed line tuning elements close to the feed line and spatially separated from one another, and wherein the connecting of one or more of the tuning elements to the conductive parts includes electrically connecting one or more of the feed line tuning elements to the feed line, or disconnecting one or more of the feed line tuning elements from the feed line, to change dimensions and shape of the feed line to reconfigure the CRLH MTM antenna structure to generate a second high RH mode resonance that has a different frequency from the first high RH mode resonance.

12. The method as in claim 10, wherein the cell patch and the via line are formed on different surfaces of the substrate, and wherein the method comprises:

forming a via pad to be connected to the via line; and forming a via in the substrate to connect the cell patch and the via pad.

13. The method as in claim 10, wherein the forming of the plurality of tuning elements on the substrate includes forming cell patch tuning elements close to the cell patch and spatially separated from one another, and wherein the connecting of one or more of the tuning elements to the conductive parts includes a step of electrically connecting one or more of the cell patch tuning elements to the cell patch, or disconnecting one or more of the cell patch tuning elements from the cell patch, to change dimensions and shape of the cell patch to reconfigure the CRLH MTM antenna structure to generate a second LH mode resonance that has a different frequency from the first LH mode resonance.

14. The method as in claim 10, wherein the forming of the plurality of tuning elements on the substrate includes forming meander stub tuning elements attached to the meander stub, and wherein the connecting of one or more of the tuning elements to the conductive parts includes a step of electrically connecting two or more of the meander stub tuning elements to each other, or disconnecting two or more of the meander tuning elements from each other, to change dimensions and shape of the meander stub to reconfigure the CRLH MTM antenna structure to generate a second low RH mode resonance that has a different frequency from the first low RH mode resonance.

15. The method as in claim 10, wherein the forming of the plurality of tuning elements on the substrate includes forming via line tuning elements close to the via line and spatially separated from each other, and wherein the connecting of one or more of the tuning elements to the conductive parts includes a step of electrically connecting one or more of the via line tuning elements to the via line, or disconnecting one or more of the via line tuning elements from the via line, to change dimensions and shape of the via line to reconfigure the CRLH MTM antenna structure to generate a second LH mode resonance that has a different frequency from the first LH mode resonance.

16. The method of claim 12, wherein forming the plurality of tuning elements on the substrate includes forming a plurality of via pad tuning elements close to the via pad, the via pad tuning elements being spatially separated from one another, and wherein electrically connecting one or more of the via pad tuning elements to the via pad to become part of the via pad or disconnecting one or more of the via pad tuning elements from the via pad changes a dimension and a shape of the via pad to reconfigure the CRLH MTM antenna structure to generate a second LH mode resonance that has a different frequency from the first LH mode resonance.

17. The method of claim 10, wherein the cell patch is formed on a first metallization layer of the substrate; and wherein the ground electrode is formed on a different second metallization layer of the substrate, the ground electrode located outside a footprint of the cell patch projected from the first metallization layer of the substrate to the second metallization layer of the substrate.

18. The method as in claim 10, wherein two selected tuning elements are connected to the CRLH MTM antenna structure, and the two selected tuning elements are connected to two different conductive parts of the CRLH MTM antenna structure, respectively.

19. The method as in claim 10, wherein two selected tuning elements are connected to the CRLH MTM antenna structure, and wherein the two selected tuning elements are connected to each other and one of the two selected tuning elements is connected to one of the conductive parts of the CRLH MTM antenna structure.

20. The method as in claim 10, wherein two selected tuning elements are connected to the CRLH MTM antenna structure by being connected to a common conductive part of the CRLH MTM antenna structure.

21. The method as in claim 10, wherein the tuning elements are electrically conductive patches.

22. The method as in claim 21, wherein at least two of the electrically conductive patches are different in size or shape.

23. The method as in claim 10, comprising using a zero-ohm resistor to electrically connect a selected tuning element to the CRLH MTM antenna structure.

* * * * *